US009014596B2

(12) United States Patent
Kikuchi et al.

(10) Patent No.: US 9,014,596 B2
(45) Date of Patent: Apr. 21, 2015

(54) ELECTROPHOTOGRAPHIC IMAGE FORMING APPARATUS

(75) Inventors: Ken Kikuchi, Mishima (JP); Tsutomu Nishiuwatoko, Numazu (JP); Takashi Akutsu, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 160 days.

(21) Appl. No.: 13/453,348

(22) Filed: Apr. 23, 2012

(65) Prior Publication Data

US 2012/0213550 A1 Aug. 23, 2012

Related U.S. Application Data

(62) Division of application No. 12/725,732, filed on Mar. 17, 2010, now Pat. No. 8,185,013.

(30) Foreign Application Priority Data

Mar. 23, 2009 (JP) ..... 2009-069959
Feb. 17, 2010 (JP) ..... 2010-032415

(51) Int. Cl.
*G03G 21/16* (2006.01)
*G03G 15/16* (2006.01)

(52) U.S. Cl.
CPC .... *G03G 15/1605* (2013.01); *G03G 2221/1654* (2013.01); *G03G 21/1623* (2013.01); *G03G 21/1647* (2013.01)

(58) Field of Classification Search
USPC ..... 399/107, 110–114, 121, 297, 299, 302, 399/308
See application file for complete search history.

(56) References Cited

U.S. PATENT DOCUMENTS

| | | | | |
|---|---|---|---|---|
| 6,141,513 | A | 10/2000 | Nishiuwatoko et al. | |
| 6,336,012 | B1 | 1/2002 | Noda et al. | |
| 6,366,746 | B1 | 4/2002 | Sasago et al. | |
| 6,385,413 | B2 | 5/2002 | Sasaki et al. | |
| 6,453,136 | B1 | 9/2002 | Yasumaru | |
| 6,606,469 | B2 | 8/2003 | Kikuchi et al. | |
| 6,968,138 | B2 | 11/2005 | Akutsu | |
| 7,391,991 | B2 * | 6/2008 | Suda et al. | 399/111 |
| 7,684,728 | B2 * | 3/2010 | Okabe et al. | 399/111 |

(Continued)

FOREIGN PATENT DOCUMENTS

JP 2006-184901 A 7/2006

*Primary Examiner* — Hoan Tran
(74) *Attorney, Agent, or Firm* — Fitzpatrick, Cella, Harper & Scinto

(57) ABSTRACT

An electrophotographic image forming apparatus includes an image forming unit including a transfer member for transferring a developed image formed on an electrophotographic photosensitive drum, and a mounting portion for demountably mounting a cartridge, the image formation unit being movable, in a state that the cartridge is demountably mounted, between a transfer position for transferring the developed image, and a mounting and demounting position, different from the transfer position, and a regulating member for limiting movement of the cartridge mounted to the mounting portion, when the unit moves between the transfer position and the mounting and demounting position, the regulating member being movable between a regulating position for limiting the movement of the cartridge, and a permitting position for permitting mounting and demounting of the cartridge, and the regulating member being in a regulating position when the unit moves between the transfer position and the mounting and demounting position.

12 Claims, 26 Drawing Sheets

(56) References Cited

U.S. PATENT DOCUMENTS

| | | | | |
|---|---|---|---|---|
| 7,689,139 | B2 * | 3/2010 | Kamimura | 399/90 |
| 7,715,752 | B2 | 5/2010 | Sakurai et al. | |
| 7,720,412 | B2 * | 5/2010 | Anan et al. | 399/115 |
| 7,725,051 | B2 * | 5/2010 | Lee | 399/111 |
| 7,890,012 | B2 | 2/2011 | Koishi et al. | |
| 7,920,807 | B2 | 4/2011 | Tomatsu | |
| 8,238,785 | B2 * | 8/2012 | Kawai | 399/111 |
| 2003/0053819 | A1 | 3/2003 | Nomura et al. | |
| 2007/0147890 | A1 | 6/2007 | Hayakawa | |
| 2007/0160380 | A1 | 7/2007 | Imaizumi et al. | |
| 2007/0160386 | A1 | 7/2007 | Kawamura | |
| 2008/0181658 | A1 | 7/2008 | Okabe | |
| 2010/0239308 | A1 | 9/2010 | Kikuchi et al. | |
| 2010/0239312 | A1 | 9/2010 | Kikuchi et al. | |
| 2010/0247138 | A1 | 9/2010 | Kikuchi et al. | |
| 2010/0247140 | A1 | 9/2010 | Kikuchi et al. | |
| 2010/0247142 | A1 | 9/2010 | Kikuchi et al. | |

* cited by examiner (a)

(b)

(c)

ELECTROPHOTOGRAPHIC IMAGE FORMING APPARATUS

This application is a divisional of U.S. patent application Ser. No. 12/725,732, filed Mar. 17, 2010 now U.S. Pat. No. 8,185,013.

FIELD OF THE INVENTION AND RELATED ART

The present invention relates to an electrophotographic image forming apparatus, wherein a cartridge is dismountably mounted to a main assembly, and an image is formed on a recording material.

Here, the electrophotographic image forming apparatus forms an image on the recording material using an electrophotographic image forming process. The examples of the electrophotographic image forming apparatus include an electrophotographic copying machine, an electrophotographic printer (a laser beam printer, an LED printer, for example), a facsimile device, and a word processor. The image is formed by the electrophotographic image forming apparatus on a recording material, and the recording material is, for example, paper or an OHP sheet.

The cartridge is a process cartridge, a developing cartridge or the like and contributes to an image forming process for forming the image on the recording material in the state where it is mounted to the main assembly of the electrophotographic image forming apparatus. Here, the process cartridge contains at least one of charging means, developing means, cleaning means as process means, and the electrophotographic photosensitive drum as a unit integrally, and is dismountably mountable to the main assembly. The process cartridge may contain the developing means as the process means and the electrophotographic photosensitive drum as a unit, and is dismountably mounted to the main assembly of the electrophotographic image forming apparatus. The process cartridge may contain the charging means, the developing means, or the cleaning means as the process means and the electrophotographic photosensitive drum as a unit, and is dismountably mounted to the main assembly. The process cartridge which is provided integrally with the electrophotographic photosensitive drum and the developing means is called an integral-type process cartridge. The process cartridge which is provided integrally with the electrophotographic photosensitive drum and the process means other than the developing means is called a discrete type process cartridge. In this case, the developing means is provided in a developing unit separate from the process cartridge, and the discrete type process cartridge forms the image using the combination with such a developing unit. The mounting and demounting of the process cartridge can be carried out relative to the main assembly by a user. For this reason, the maintenance of the apparatus is easy. The act of the process means is carried out on the electrophotographic photosensitive drum.

The developing cartridge has the developing roller, contains the powdery developer toner having developed the electrostatic latent image formed on the photosensitive drum by the developing roller used, and is dismountably mounted to the apparatus main assembly. In the case of the developing cartridge, the electrophotographic photosensitive drum is mounted to a main assembly or a cartridge supporting member. Or, the electrophotographic photosensitive drum is provided in a so-called discrete type process cartridge. In this case, the process cartridge is not provided with the developing means. The developing cartridge can also carry out the mounting and demounting relative to said main assembly by the user. For this reason, the maintenance of the apparatus is easy.

Therefore, the cartridge in this invention includes the process cartridges of a so-called integral type or a so-called discrete type. The cartridge includes a combination of the so-called process cartridge of the discrete type and the developing cartridge. In another example of the cartridge, the electrophotographic photosensitive drum is mounted fixedly to the main assembly or the cartridge supporting member, and the detachably mountable developing cartridge acts on the electrophotographic photosensitive drum.

As has been described herein, the electrophotographic image forming apparatus for forming the image on the recording material using the electrophotographic image forming process is known. In this electrophotographic image forming apparatus, the process cartridge type described above is known. In addition, the developing cartridge type, which comprises only the developing unit separate from the photosensitive drum, is known. In the present invention, the process cartridge type and the developing cartridge type are usable. The process cartridge and the developing cartridge are provided with a developer accommodating portion which contains the developer (toner) for developing the electrostatic latent image.

A known color image forming apparatus employs a cartridge tray as a drawer member which carries a plurality of cartridges, and the cartridge tray is drawn in the direction in which the cartridges are juxtaposed, by which an exchanging operation of the cartridge is made easy (US2007-160380).

SUMMARY OF THE INVENTION

The present invention further develops the conventional structure described above.

An object of the present invention is to provide an electrophotographic image forming apparatus, wherein the cartridge is substantially prevented from moving outwardly of the image forming unit.

Another object of the present invention is to provide an electrophotographic image forming apparatus, which uses an image forming unit which is movable between a mounting and dismounting position for a mounting and demounting of the cartridge and a transfer position for transferring a developer image onto the recording material from a transfer member in the state that the cartridge is mounted, wherein the cartridge is substantially prevented from moving relative to the image forming unit.

According to an aspect of the present invention, there is provided an electrophotographic image forming apparatus for forming an image on a recording material, comprising an image forming unit including a transfer member for transferring a developed image formed on an electrophotographic photosensitive drum, and a mounting portion for demountably mounting a cartridge, said image formation unit being movable, in a state that said cartridge is demountably mounted to said mounting portion, between a transfer position for transferring the developed image from said transfer member onto the recording material in a main assembly of said electrophotographic image forming apparatus, and a mounting and demounting position, different from the transfer position, for mounting and demounting said cartridge relative to said mounting portion; and a regulating member for limiting movement, outward of said image forming unit, of said cartridge mounted to said mounting portion, when said image forming unit moves between the transfer position and the mounting and demounting position, said regulating member being movable between a regulating position for limiting the movement, outward of said image forming unit, of said cartridge, and a permitting position for permitting mounting and demounting of said cartridge relative to said mounting portion, and said regulating member being in a regulating position when said image forming unit moves between the transfer position and the mounting and demounting position.

In an aspect of the present invention, an electrophotographic image forming apparatus is provided wherein the cartridge is substantially prevented from moving outwardly of the image forming unit.

In another aspect of the present invention, in an electrophotographic image forming apparatus, which uses an image forming unit which is movable between a mounting and dismounting position for a mounting and demounting of the cartridge and a transfer position for transferring a developer image onto the recording material from a transfer member in the state that the cartridge is mounted, the cartridge is substantially prevented from moving relative to the image forming unit.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENT

The preferred embodiments of the present invention will be described in conjunction with the accompanying drawings. The dimensions, the materials, the configurations, the relative positions, and so on of the constituent parts which will be described hereinafter may be properly changed by one skilled in the art depending on the structures and the various conditions of a device to which this invention is applied, and the scope of this invention is not limited to specific dimensions, materials, configurations, relative positions and so on of the embodiments which will be described below.

Figure 1A:
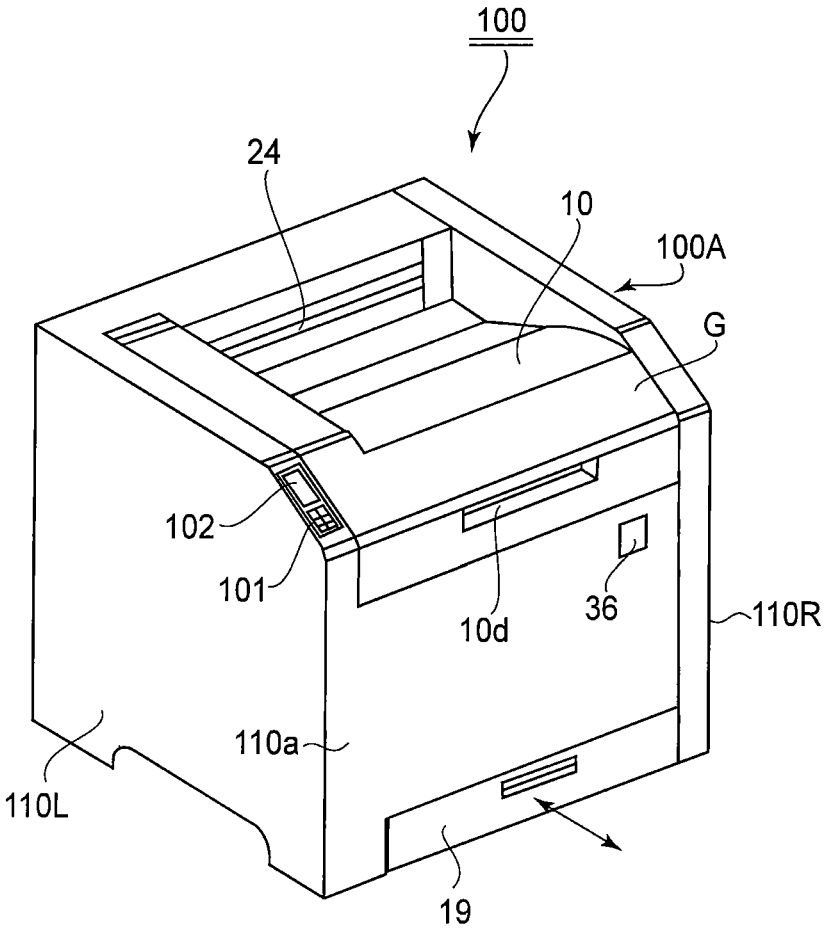
FIG. 1A is an outer appearance perspective view of an image forming apparatus according to an embodiment of the present invention.
Figure 1B:
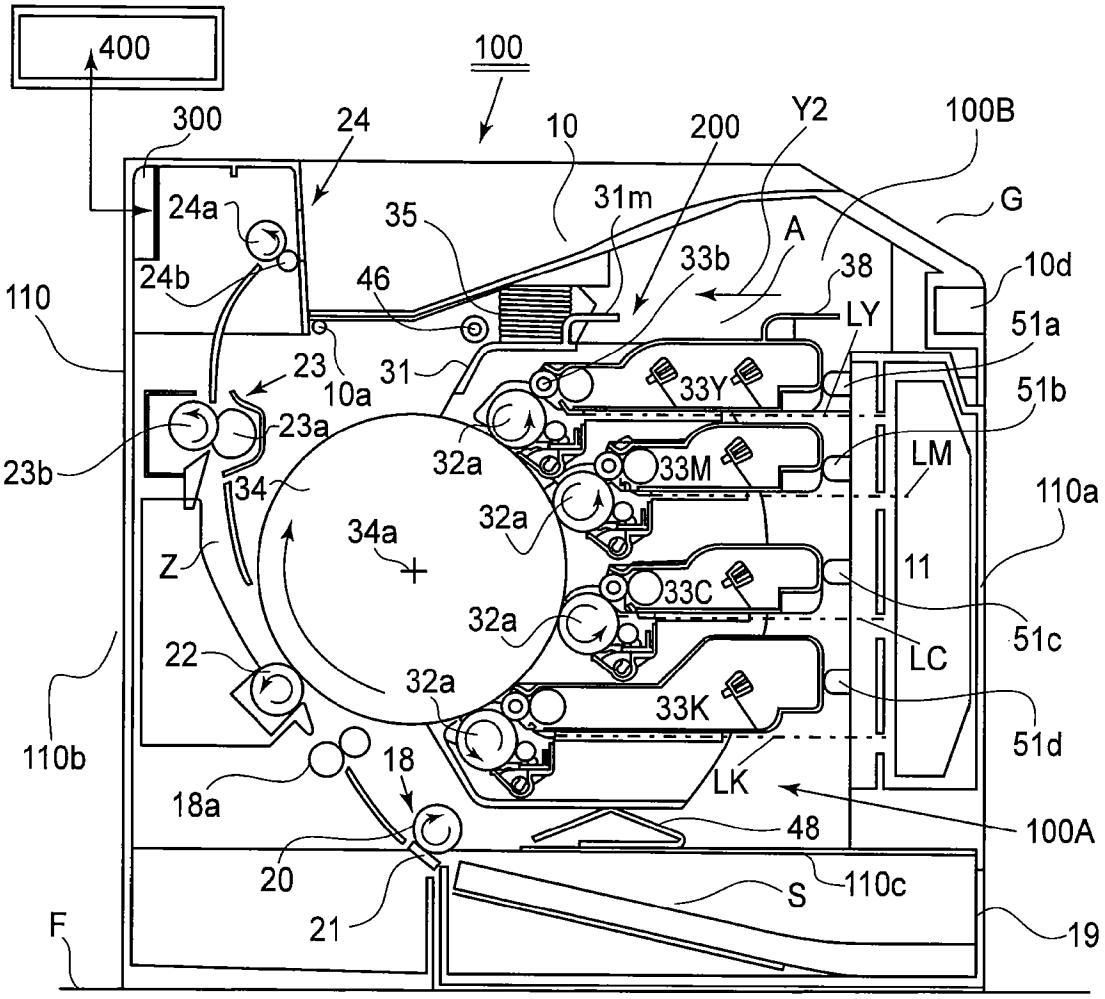
FIG. 1B is a vertical section left side view thereof.

The embodiment (general arrangement of a color electrophotographic image forming apparatus) in FIG. 1A is an outer appearance perspective view of a color electrophotographic image forming apparatus (image forming apparatus) 100 in this embodiment. FIG. 1B is a vertical section left side view of an image forming apparatus 100. The image forming apparatus 100 is a laser printer of a full-color (four colors) type which uses the electrophotographic process. The image forming apparatus 100 forms a full-color image on a recording material (sheet) S on the basis of the electrical image signal inputted to a control circuit portion 300 from an external host device 400 such as a personal computer, an image reader, or a receiving part of a facsimile device.

In the following descriptions, relating to the image forming apparatus 100, a front side is the side in which a feeding cassette 19 for stacking and accommodating recording materials S is drawn out of an inside of a main assembly 100A to an outside. A backside is the opposite side from the front side. An upper side is a side where a maintenance cover 10 is opened. The front-rear direction is a direction to the front side from the backside of the image forming apparatus, and vice versa. The left and right are the left and right, as seen from the front side of the image forming apparatus. The left-right direction is a direction to the left from the right, and vice versa. A longitudinal direction is a direction of an axis of an electrophotographic photosensitive drum or a developing roller. The main assembly 100A constitutes portions of the image forming apparatus other than the cartridges 33 (33Y, 33M, 33C and 33K) and an image forming unit 200. In the image forming apparatus of this embodiment, a right-hand side is a driving side, and a left-hand side is the non-driving side.

Figure 2:
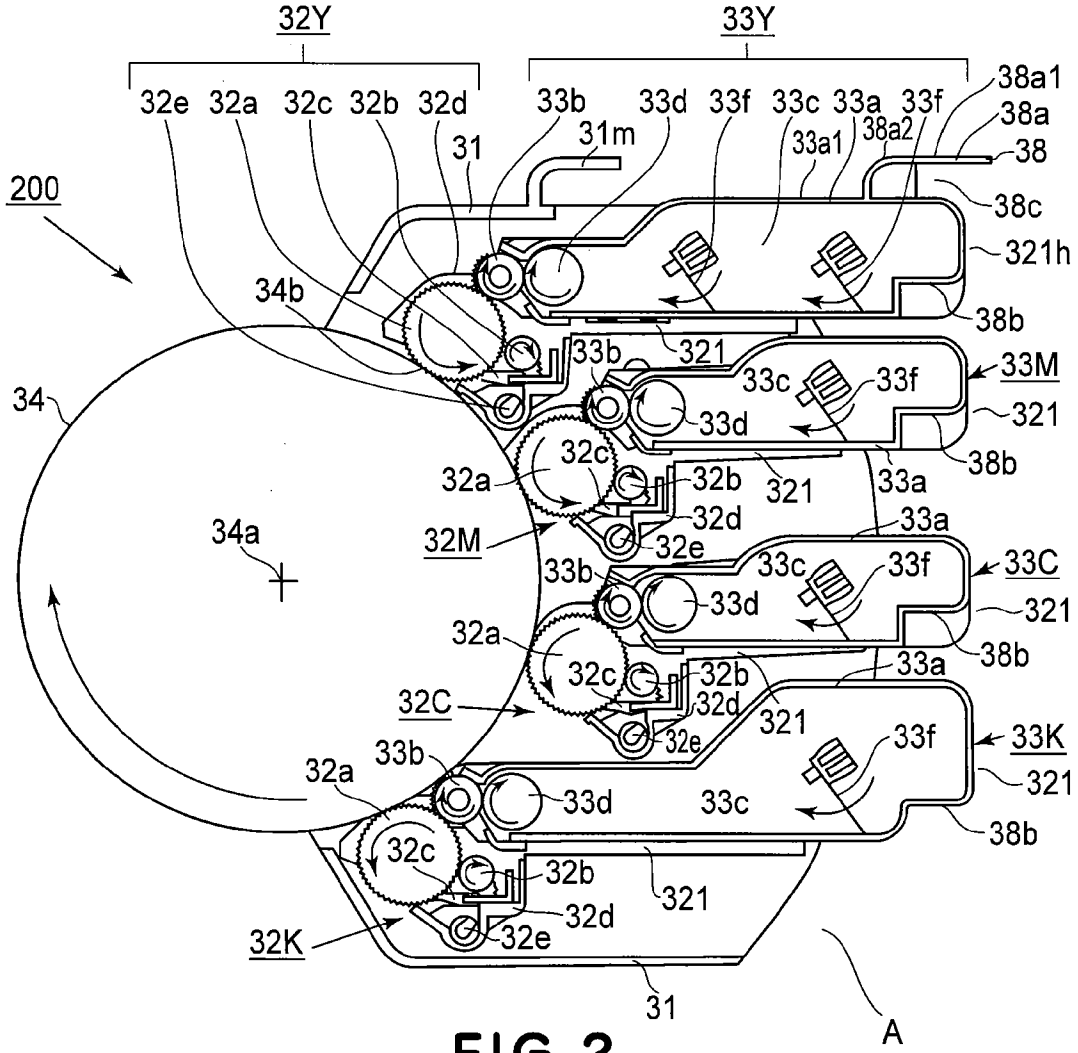
FIG. 2 is an enlarged view of an image forming unit shown in FIG. 1B.

The image forming apparatus 100 is placed on a substantially horizontal installation surface F such as a mounting base, the desk or the floor. A central portion in the main assembly 100A is provided with the image forming unit 200. FIG. 2 is an enlarged view of the image forming unit 200 shown in FIG. 1B. A unit 200 is provided with the cartridge mounting portion (mounting guide) 321 for dismountably mounting the plurality of cartridges (in the present embodiment, the first—fourth developing cartridges 33 (33Y, 33M, 33C and 33K)) and a single intermediary transfer member (transfer member) 34. The mounting portion (mounting guide) 321 dismountably mounts the cartridge 33 which is provided with a developing roller (developing member) 33*b*. The developing roller 33*b* develops an electrostatic latent image formed on a photosensitive drum 32*a* by a developer. A transfer member 34 transfers a developer image transferred from each photosensitive drum 32*a* onto the recording material S. The photosensitive drum 32*a* opposes the developing roller 33*b* of the cartridge 33 mounted to the mounting portion 321 and is mounted to the unit 200. In the state that the apparatus 100 is provided on the installation surface F, such mounting portions 321 are disposed along the perpendicular direction. In this embodiment, an electrophotographic photosensitive drum 32*a* corresponding to the developing cartridge 33 is mounted to the unit 200 as part of a photosensitive member unit 32 (32Y, 32M, 32C, 32K) with a charging roller 32*b* and a cleaning blade 32*c*. The charging roller 32*b* and the cleaning blade 32*c* are process means. In the device 100, the cartridges 33 are dismountably mounted to main assembly 100A (unit 200), and a color image is formed on the recording material S. The unit 200 will be described in detail hereinafter. In this embodiment, the cartridges 33 have similar structures, except for the colors of the contained powdery developers (toner). However, they are not limited to this example. For example, a developing cartridge 33K which accommodates a black developer may have a larger capacity developer accommodating portion 33*c* than the developing cartridges 33 which accommodate the developers of the other colors. In this embodiment, the cartridge is a developing cartridge, although the present invention is not limited to this. For example, the drum 32*a*, the charging roller 32*b*, and the cleaning blade 32*c* mounted to the unit 200 in this embodiment may be mounted to the developing cartridge 33. In such a case, the cartridge is a process cartridge. And, the drum 32*a* and a charging roller (charging member) 32*b*, a developing roller (development member) 33*b*, and a cleaning blade (cleaning member) 32*c* as the process means are unified into the cartridge, and the cartridge is dismountably mounted to the main assembly 100A.

(Photosensitive Member Unit)

Each of the units 32 (32Y, 32M, 32C and 32K) is fixed to a sub-frame 31 of the image forming unit 200. Each unit 32 includes the drum 32*a*. The unit 32 includes the charging roller 32*b* and the cleaning blade 32*c* for removing the developer which remained on the surface of the drum 32*a*, as the process means which acts on the drum 32*a*. The feeding screw (feeding member) 32*e* for feeding, in the axial direction of the drum 32*a*, the developer removed by the cleaning blade 32*c* is provided. The drum 32*a*, the charging roller 32*b*, the cleaning blade 32*c*, and the feeding screw 32*e* are disposed with a predetermined arrangement relation relative to a case 32*d*.

Figure 3:
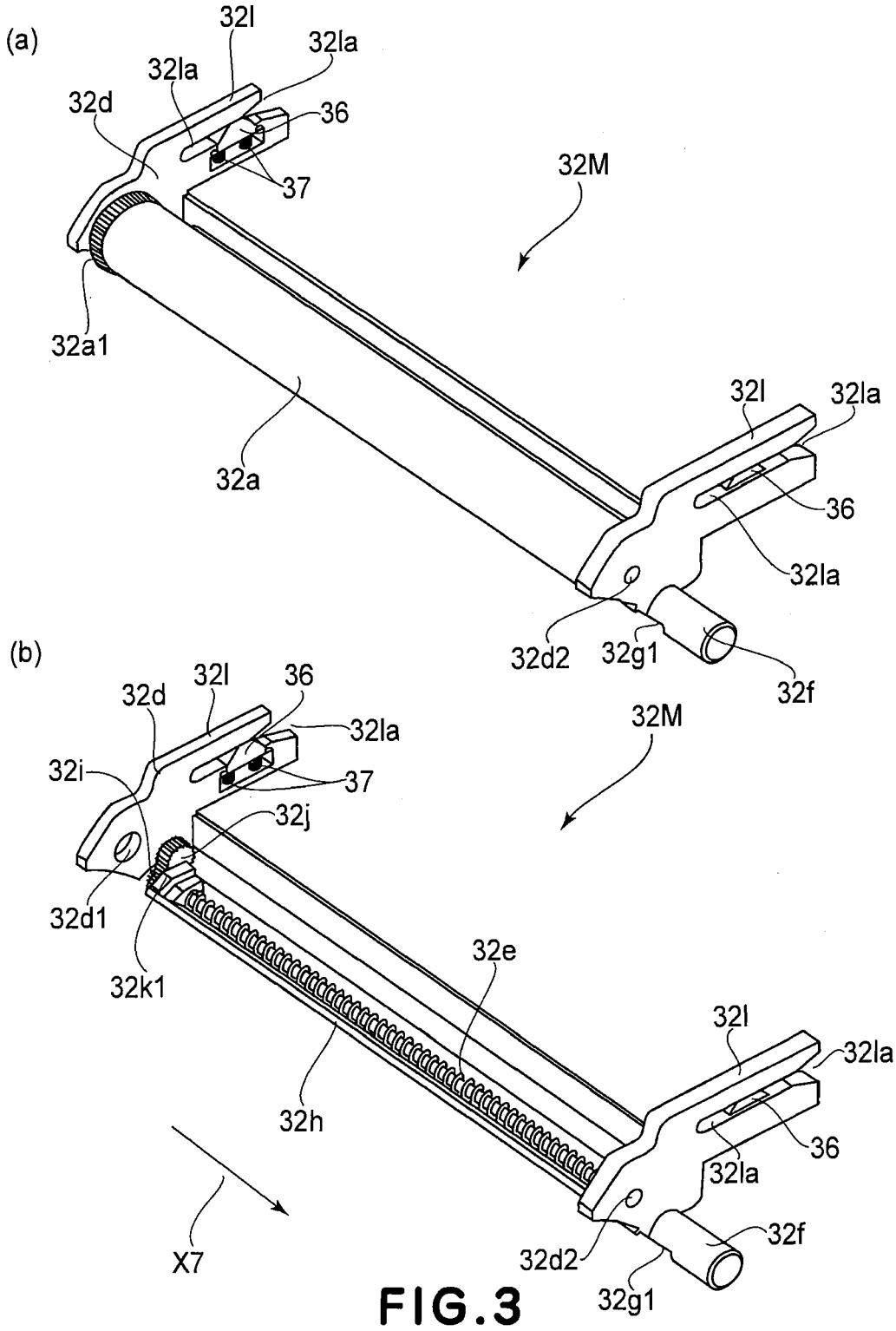
FIG. 3(*a*) is a left-hand side perspective view of a photosensitive member unit, and FIG. 3(*b*) is a perspective view of a photosensitive member case in which a drum or the like is dismounted from the unit shown in FIG. 3(*a*).
Figure 4:
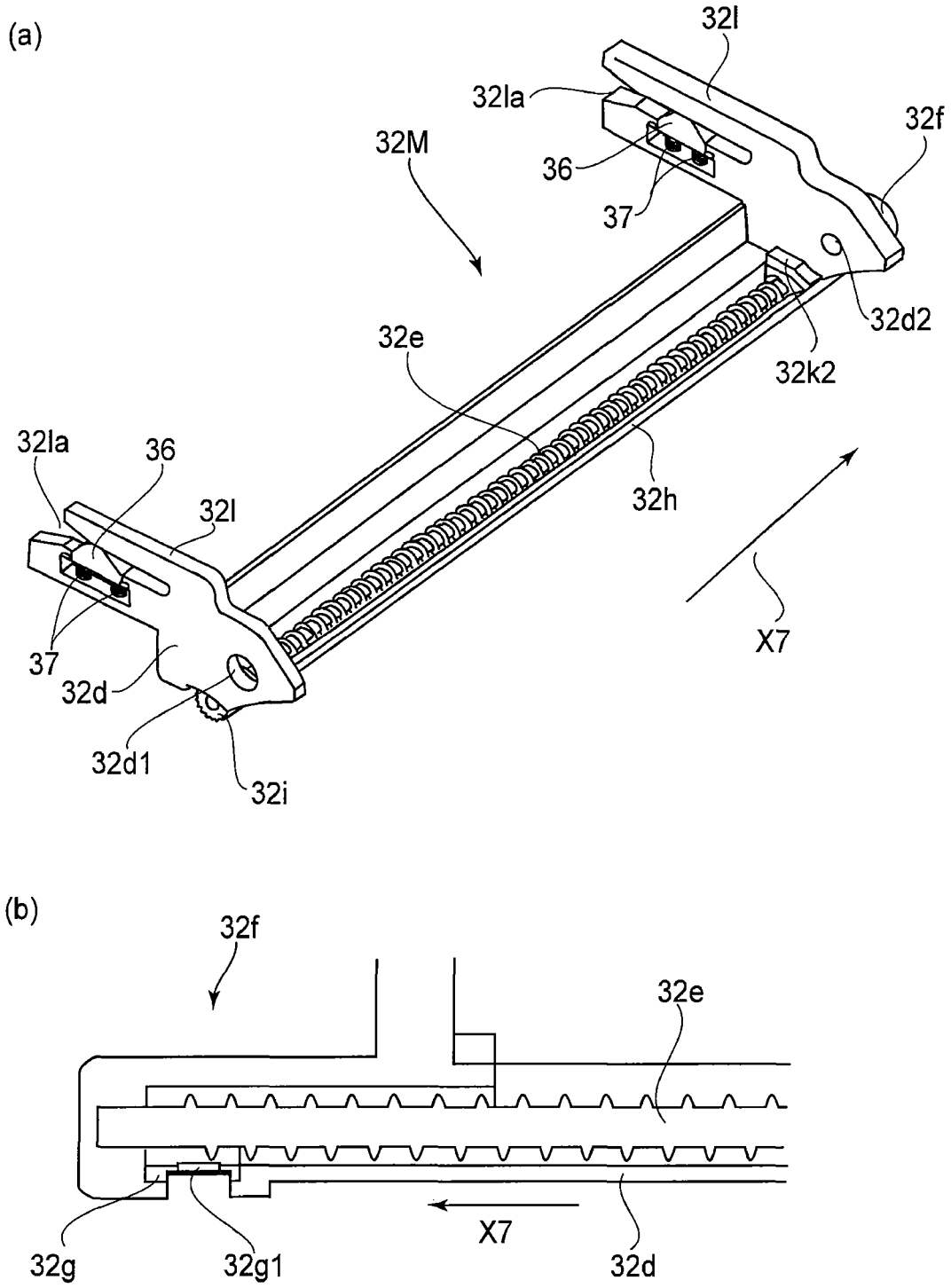
FIG. 4(*a*) is a right-hand side perspective view of the photosensitive member case of FIG. 3(*b*), and FIG. 4(*b*) is an enlarged vertical longitudinal sectional view of a removed developer discharging portion of the photosensitive member case.

FIG. 3(*a*) is a perspective view of a unit 32M, as seen from left-hand side. FIG. 3(*b*) is a perspective view of a photosensitive member case 32*d* excluding the drum 32*a*, the charging roller 32*b*, and the cleaning blade 32*c* from the unit 32M of FIG. 3(*a*). FIG. 4(*a*) is a perspective view of the case 32*d* of FIG. 3(*b*), as seen from a right-hand side, and FIG. 4(*b*) is an enlarged vertical longitudinal sectional view of a removed developer discharging portion 32*f* of the case 32*d*. The other units 32Y, 32C and 32K have substantially the same structures, and therefore, a description will be provided as to the photosensitive member unit 32M. A right-hand end portion and a left-hand end portion of the case 32*d* are provided with the bearing portions 32*d*1 and 32*d*2 which comprise through-holes, respectively, which support the drum 32*a* rotatably. The insides of the bearing portions 32*d*1 or 32*d*2 are provided with the end sealing members 32*k*1, 32*k*2 contacting the drum 32*a* and the sheet-like sealing members 32*h* extended in the axial direction of the drum 32*a*. Each of the sealing members 32*k*1, 32*k*2 and 32*h* contacts to the surface of the drum 32*a*, so that the developer in the case 32*d* does not leak to an outside. An inside of the case 32*d* is provided with the feeding screw 32*e* extended in the longitudinal direction. The right-hand end portion of the screw 32*e* is provided with the feeding gear 32*i*, which receives a driving force from a drum gear 32*a*1 provided at the right-hand end portion of the drum 32*a* through an idler gear 32*j*. A removed developer in the case 32*d* is fed in the direction of the arrow X7 (leftward direction) by rotating operation of the screw 32*e*. The removed developer fed by the screw 32*e* is carried to the removed developer discharging portion 32*f* provided at the left-hand end portion of the screw 32*e*. The discharging portion 32*f* outwardly projects out of the left-hand end portion of the case 32*d*. The removed developer fed by the screw 32*e* is discharged to the outside through an opening 32*g*1 provided in the discharging portion 32*f*. The opening 32*g*1 is provided with a rotatable shutter 32*g*. The shutter 32*g* is rotatable between an open position for opening the opening 32*g*1 and a closing position for closing the opening 32*g*1. The shutter 32*g* is moved to the open position by the mounting operation, to the unit 200, of the residual developer container 40 (FIG. 12, FIG. 13) as will be described hereinafter. By this, the removed developer in the case 32*d* can be discharged to the inside of the container 40. When the container 40 is not mounted, the shutter 32*g* is urged to the closed position by a spring (unshown), and therefore, the developer does not leak outwardly.

The right-hand end portion and the left-hand end portion of each unit 32 is provided with the mounting portion 321 for mounting the cartridge 33, and the mounting portions 321 are extended in the direction perpendicular to the axes of the drums 32*a*, respectively. A part of a mounting portion 321 is provided with a recess 321*a* for receiving the portions-to-be-guided (portions-to-be-regulated) 33*e*1 and 33*e*3 (FIG. 5) of the cartridge 33. Adjacent the recess 321*a*, a regulating member 36 for regulating a position of the cartridge 33 and the urging member 37 for urging the regulating member 36 are provided.

Each unit 32 is provided with the feeding screw 32*e* for feeding the removed developer to the outside. For this reason, the space for containing the removed developer is not required of the inside of a unit 32. Therefore, the unit 32 can be downsized. In this embodiment, the unit 32 is fixed to the unit 200. Therefore, when drum 32*a* or the like is worn, the whole unit 200 is exchanged. However, the unit 32 may be detachably mountable to the unit 200, and in such a case, only the unit 32 is exchanged.

(Cartridge)

As shown in FIG. 2, each of the cartridges 33 (33Y, 33M, 33C and 33K) is provided with a case 33*a* and the developing roller 33*b* for developing the electrostatic latent image formed on the drum 32*a* into the developer image by supplying the developer to the drum 32*a*. The cartridge 33 is provided with a developer accommodating portion 33*c* which accommodates the developer to be used for the development of the electrostatic latent image and a supplying roller 33*d* for supplying the developer from the developer accommodating portion 33*c* to the developing roller 33*b*. The developer accommodating portion 33*c* is provided with the feeding member 33*f* for feeding the inner developer to the supplying roller 33*d*. A first cartridge 33Y accommodates the yellow (Y) color developer in the developer accommodating portion 33*c*, and a Y color developer image is formed on the surface of the corresponding drum 32*a*. A second cartridge 33M accommodates the magenta (M) color developer in the developer accommodating portion 33*c*, and a M color developer image is formed on the surface of the corresponding drum 32*a*. A third cartridge 33C accommodates the cyan (C) color developer in the developer accommodating portion 33*c*, and a C color developer image is formed on the surface of the corresponding drum 32*a*. A fourth cartridge 33K accommodates the black (K) color developer in the developer accommodating portion 33*c*, and a K color developer image is formed on the surface of the corresponding drum 32*a*. Therefore, the cartridges 33 which contain the different color developers are mounted to the mounting portions 321.

Figure 5:
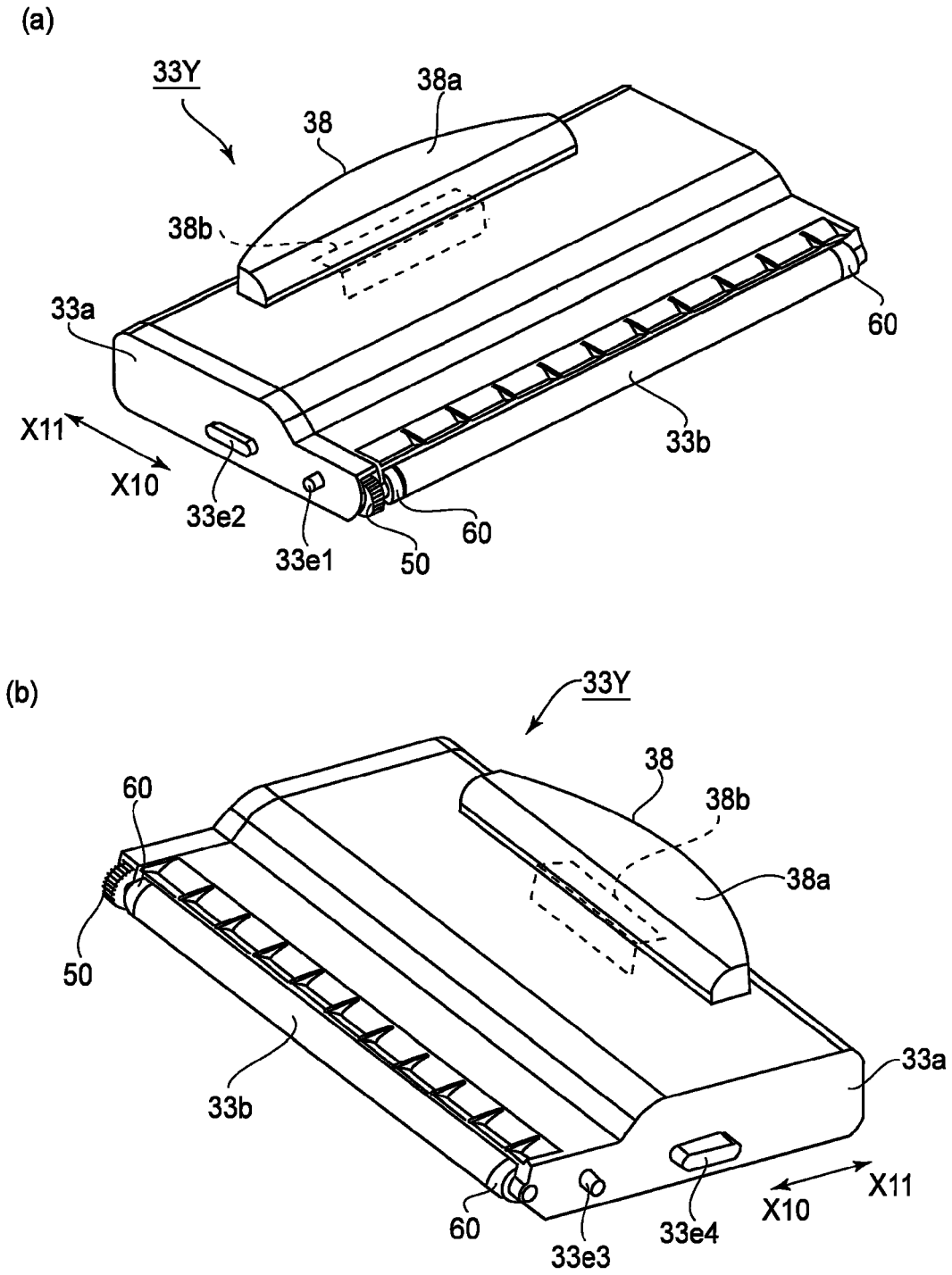
FIG. 5(*a*) is a right-hand side perspective view of a cartridge, and FIG. 5(*b*) is a left-hand side perspective view thereof.

FIG. 5(*a*) is a perspective view of the cartridge 33Y, as seen from right-hand side, and FIG. 5(*b*) is a perspective view of the cartridge 33Y, as seen from the left-hand side. The cartridges 33 will be described as to the case of cartridge 33Y. The cartridge 33Y is mounted in the direction of the arrow X10 to the mounting portion 321 of the unit 200. The cartridge 33Y is dismounted from the mounting portion 321 of the unit 200 in the direction of the arrow X11 opposite to the arrow X10. The cartridge 33Y is provided with the developing roller 33*b* in a leading end with respect to the mounting direction. Here, the directions of the arrow X10 and the arrow X11 are orthogonal to the longitudinal direction (axial direction) of the developing roller 33*b*. The right-hand end portion of the developing roller 33*b* is provided with a gear 50, which receives the driving force from the drum gear 32*a*1 to rotate the developing roller 33*b*. The gear 50 transmits the driving force to the supplying roller 33*d* and the feeding member 33*e* through a gear train (unshown). Each of the right-hand end portion and the left-hand end portion of the cartridge 33Y is provided with the portions-to-be-guided 33*e*1, 33*e*2, 33*e*3 and 33*e*4 for being guided by the unit 200, when the cartridge 33Y is mounted to the unit 200. The portions-to-be-guided 33*e*1 and 33*e*3 have a cylindrical shape, and project toward the outside of the one-end portion and the outside of the other end portion of the cartridge 33Y. Here, the one-end portion is with respect to the longitudinal direction of the developing roller 33*b*. The other end portion is the side opposite from the one-end portion in the longitudinal direction. The portions-to-be-guided 33*e*2 and 33*e*4 have a substantially rectangular parallelepiped shape, and project toward the outside of the one-end portion and toward the outside of the other end portion of the cartridge 33Y, and are extended in the direction perpendicular to the longitudinal direction of the cartridge 33. The portions-to-be-guided 33*e*1 and 33*e*3 are placed in a downstream side (with respect to the mounting direction X10 of cartridge 33Y) of the portions-to-be-guided 33*e*2, 33*e*4, respectively. The cartridge 33Y is provided with a first grip 38 for gripping the cartridge 33Y. The first grip 38 is provided with an upper side grip 38*a* and a lower side grip 38*b*. The grip, 38 is provided in a central portion (with respect to the longitudinal direction) of the developing roller 33*b*, and in an upstream side with respect to the mounting direction X10, (FIGS. 2, 5(*a*) and 5(*b*)). More particularly, the grip 38 is provided in the side opposite from the side which is provided with the developing roller 33*b*. The mounting direction X1 is the same as an entrance direction of making the cartridge 33Y enter the mounting portion 321. The grip 38*a* projects upwardly from the top surface 33*a*1 of the cartridge 33Y, in the state that the cartridge 33Y is mounted to the mounting portion 321. The grip 38*a* is extended upwardly from the top surface 33*a*1 (FIGS. 2, 5(*a*) and 5(*b*)), and is provided with the flat surface portion 38*a*1 which is in parallel with a surface 33*a*1. A gap 38*c* is provided between the top surface 33*a*1 and the flat surface portion 38*a*1. The grip 38*b* is provided by recessing a bottom plate of the case 33*a* out. When a user holds the cartridge 33Y by hand, the user grips the flat surface portion 38*a*1 and the grip 38*b*. As will be described hereinafter, when the user moves or rotates the unit 200, the user grips the flat surface portion 38*a*1 and rotates the unit 200. The user inserts his/her hand into the gap 38*c*, and the top surface 33*a*1 and the grip 38*b* are gripped. In this manner, the cartridge 33Y may be mounted and demounted relative to the unit 200. The upper side grip 38*a* also includes the top surface 33*a*1. The mounting portions 321 are provided along the direction perpendicular to the unit 200 in the state that the device 100 is provided on the installation surface F. As has been described in the foregoing, the cartridge 33Y is provided with the first grip 38. The other cartridges PM, PC and PK have only the lower side grips 38*b*. The user can mount and demount the cartridges PM, PC and PK relative to the unit 200, while gripping the grip 38*b* and the top surface 33*a*1 of the case 33*a*.

In this embodiment, an intermediary transfer member 34 is rotatable about the substantially horizontal axis of the rotation axis 34*a*, and is a cylindrical drum. The transfer member 34 includes a cylindrical base member and an elastic member on the peripheral surface thereof. Each cartridge 33 is provided on a front side of the transfer member 34, and extends substantially parallel with the installation surface F of the main assembly 100A, and the cartridges are provided adjacent to each other with respect to the substantially vertical direction. In this embodiment, the first cartridge 33Y takes the top most stage, and the second cartridge 33M is placed therebelow. The third cartridge 33C is placed further below. The fourth cartridge 33K takes the bottommost stage position. The developing roller 33*b* of each cartridge 33 may be in contact to the drum 32*a* (contact type developing system). The developing roller 33*b* may be spaced by a predetermined small gap (predetermined distance) from the drum 32*a* (non-contact developing system).

(Scanner Unit)

Referring to FIGS. 1A and 1B, the front side (front part) of each cartridge 33 is provided with a laser scanner unit (image exposure device) 11 as an image exposure device. Here, the front side is the side in which the user mounts and demounts the cartridge 33. The unit 11 is provided between a front frame 110*a* of a main frame 110 which is a frame of the main assembly 100A and each cartridge 33 in the main assembly 100A. The unit 11 includes a laser diode, a polygonal mirror, an Fθ lens, a reflection mirror, and so on. The unit 11 outputs laser beams L (LY, LM, LC and LK) which are modulated correspondingly to the image information for the Y, M, C and K color inputted to the control circuit portion 300 from the external host device 400 to scan the drums 32*a* of the cartridges 33 for the corresponding colors (image exposure). The unit 11 is fixed to the front frame 110*a*.

(Recording Material Feeding Mechanism)

A lower portion of the image forming unit 200 is provided with a feeding unit 18. The unit 18 includes a feeding cassette 19 for stacking recording material S, a feeding roller 20, a separation pad 21, and so on. A cassette 19 is inserted and detached at the front side (front loading). In the main assembly 100A, between the transfer member 34 and a rear frame 110*b* of the main assembly 100A, there is provided a recording material feeding path Z extending from the feeding roller 20 to the upper rear portion in the main assembly 100A. A registration roller couple 18*a*, a secondary transfer roller 22, a fixing device 23, and a discharging roller pair 24 are provided along feeding path Z in this order upwardly. The fixing device 23 includes a fixing film unit 23*a* and a pressing roller 23*b*. The discharging roller pair 24 includes a discharging roller 24*a* and a discharging roller 24*b*. An upper surface of the main assembly 100A is provided with a maintenance cover 10 which functions as a discharging tray for receiving a recording material S on which the image has been formed. The cover 10 opens and closes an opening 100B provided in the upper surface of the main assembly 100A (opening and closing member). The cartridge 33 is mounted and demounted relative to the unit 200 placed in a mounting and dismounting position in which the cartridge 33 is detachably mountable (FIGS. 10(*b*) and 14A) through the opening portion 100B, as will be described hereinafter.

FIG. 1B shows the state that the apparatus is capable of image forming operation 100. In this state, the cover 10 is placed in the closed position G for closing the opening portion 100B. The unit 200 is loaded with each cartridge 33, and is placed in an image forming position A for carrying out an image formation relative to the main assembly 100A. In the image forming position A the state for transferring the developer image formed on the transfer member 34 onto the recording material S is established. A gear (drive inputting portion) 34*b* (FIGS. 6A and 6B) of the transfer member 34 of the unit 200 is in engagement with a drive outputting portion (unshown) provided in the main assembly (100A) side. An electric power supply system (unshown) provided in the main assembly (100A) is electrically connected to electrical contacts (unshown) of each unit 32 and cartridge 33. Here, the driving system and the bias voltage application type described above can employ the structure similar to the case of the normal image forming apparatus, although not shown in the Figure for the sake of simplicity.

The operation for forming a full-color image will be described. Referring to FIG. 1A, and FIG. 2, each drum 32*a* is rotationally driven in the counter-clockwise direction of the arrow at a predetermined speed. The charging roller 32*b* is rotationally driven by the drum 32*a*. The transfer member 34 is rotationally driven at the speed corresponding to the speed of the drum 32*a* in the clockwise direction (co-directional with the rotation of the drum 32*a*) of the arrow. The developing roller 33*b* and the supplying roller 33*d* are rotationally driven at the predetermined speeds in the clockwise directions of the arrows, respectively. The scanner unit 11 also is driven. In synchronism with this drive, a predetermined charging bias voltage is applied to each charging roller 32*b* at predetermined control timing. By this, the surface of the drum 32*a* is uniformly charged by the charging roller 32*b* to the predetermined polarity and predetermined potential. The scanner unit 11 scanningly exposes the surface of each drum 32*a* to the laser beams L (LY, LM, LC and LK) modulated in accordance with the corresponding Y, M, C and K image signals. By this, the electrostatic latent image corresponding to the correspondence color image signals is formed on the surface of the drum 32*a* of each cartridge P. The electrostatic latent image formed on the surface of each drum 32*a* is developed into the developer image by the developing roller 33*b* of the corresponding cartridge 33. The developing roller 33*b* is supplied with a predetermined developing bias voltage at the predetermined controlled timing. Through the above-described electrophotographic image forming process operation, a Y color developer image corresponding to a yellow component of the full-color image is formed on the drum 32*a* opposed by a cartridge 33Y. The developer image thereof is transferred (primary transfer) onto the transfer member 34 in a primary transfer nip 34*b* (FIGS. 1A and FIG. 2) which is a contact portion between the drum 32*a* and the transfer member 34. An M color developer image corresponding to a magenta component of the full-color image is formed on the drum 32*a* opposed by a cartridge 33M. Onto the color developer image already transferred onto the transfer member 34 in a nip 34*b*, it is superimposed on the developer image thereof, and it is transferred (primary transfer). A C color developer image corresponding to a cyan component of the full-color image is formed on the drum 32*a* opposed by a cartridge 33C. Onto the color+M color developer image already transferred onto the transfer member 34 in the nip 34*b*, it is superimposed on the developer image thereof, and it is transferred (primary transfer). A K color developer image corresponding to a black component of the full-color image is formed on the drum 32*a* which the cartridge 33K opposed. Onto the color+M color+C color developer image already transferred onto the transfer member 34 in the nip 34*b*, it is superimposed on the developer image thereof, and it is transferred (primary transfer). In this way, a full-color developer image of the Y color+M color+C color+K color is synthetically formed on the transfer member 34. The order of the colors of the developer images sequentially superimposedly transferred onto the transfer member 34 is not limited to the above-described order. In each drum 32*a*, an untransferred developer remaining on the drum surface after the primary transfer of the developer image onto the transfer member 34 is removed by the cleaning blade (cleaning member) 32*c*. The removed developer is fed to residual developer container (developer accommodating portion) 40 (FIG. 13(*b*)) through the feeding screw 32*e*.

On the other hand, the feeding roller 20 is rotated at the predetermined control timing. In this manner, by a cooperation of the feeding roller 20 and the separation pad 21, the separation and feeding of the sheet-like recording materials S stacked in the feeding cassette 19 is carried out one by one. The recording material S is introduced into the secondary transfer nip 34*c* (FIGS. 1A and 1B) which is the contact portion between the transfer member 34 and the transfer roller 22, at the predetermined controlled timing by the registration roller couple 18*a*. The transfer roller 22 is supplied with the secondary transfer bias voltage of the predetermined potential having the polarity opposite to that of the charge polarity of the developer at the predetermined controlled timing. By this, while the recording material S is nipped and fed by the transfer nip, the developer image on the intermediary transfer member 34 on which it is superimposed is sequentially transferred (secondary transfer) onto the surface of recording material S. The recording material S passed through the secondary transfer nip is separated from this surface of the transfer member 34 and is introduced into the fixing device 23, where it is heated and pressed by a fixing nip. By this, the color developer images are mixed and fixed on recording material S. The recording material S is discharged out of the fixing device 23, and is discharged on the cover 10 which functions as a discharging tray by discharging roller pair 24 as a full-color print. The toner remaining after the secondary transfer remaining on the surface of the transfer member 34 after the separation of the recording material S from the transfer member 34 is removed. In the case of this embodiment, the toner is electrostatically deposited onto the surface of the drum 32*a* in the primary transfer nip 34*b* in the unit 32Y between the drum 32*a* and the transfer member 34, and, and then it is removed by the cleaning blade 32*c*.

The transfer member 34 is the rotatable member of a drum configuration. The different color developer images formed on each drum 32*a* is superimposedly transferred onto the transfer member 34. The developer images transferred superimposedly is transferred all together onto the recording material S from the transfer member 34. By this, the color image is formed on the recording material S. In the case where a monochromatic image is to be formed, the color developer image K formed on the drum 32*a* to which the cartridge 33K is opposed is transferred onto the transfer member 34. The transferred black developer image is transferred onto recording material S from the transfer member 34. By which a K color image is formed on the recording material S. In this embodiment, the secondary transfer roller 22 is movable between a first position in which it contacts to the transfer member 34 and forms the secondary transfer nip and a second position spaced from the transfer member 34 by a shifting mechanism (unshown). At the time of an image forming operation of the image forming apparatus 100, the secondary transfer roller 22 is moved to the first position, and at the time of then on-image formation, it is moved to the second position. The transfer roller 22 may normally be contacted with the intermediary transfer member 34.

(Image Forming Unit)

Figure 6A:
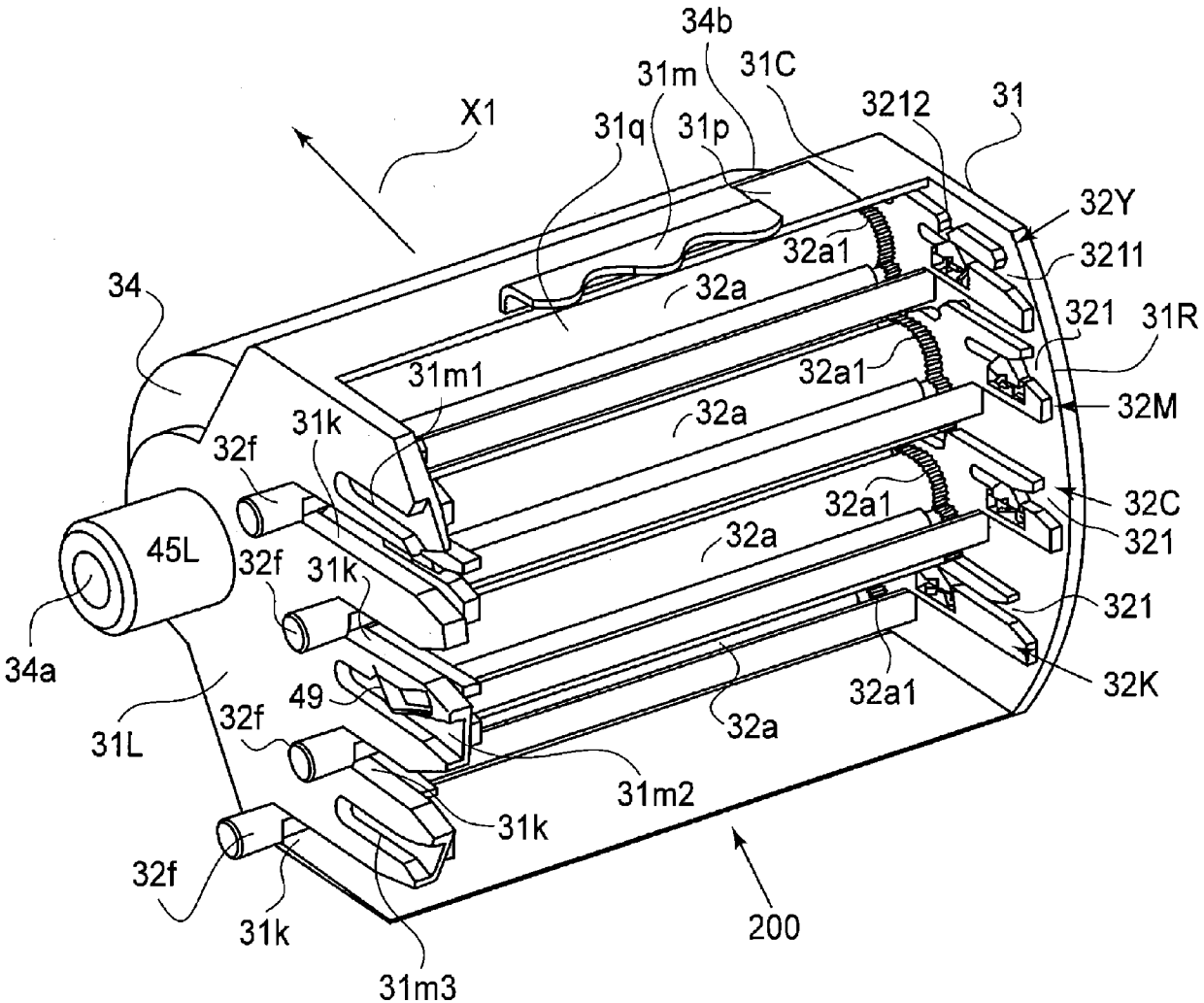
FIG. 6A is a left-hand side perspective view of an image forming unit, and, and FIG. 6B is a right-hand side perspective view thereof.
Figure 6B:
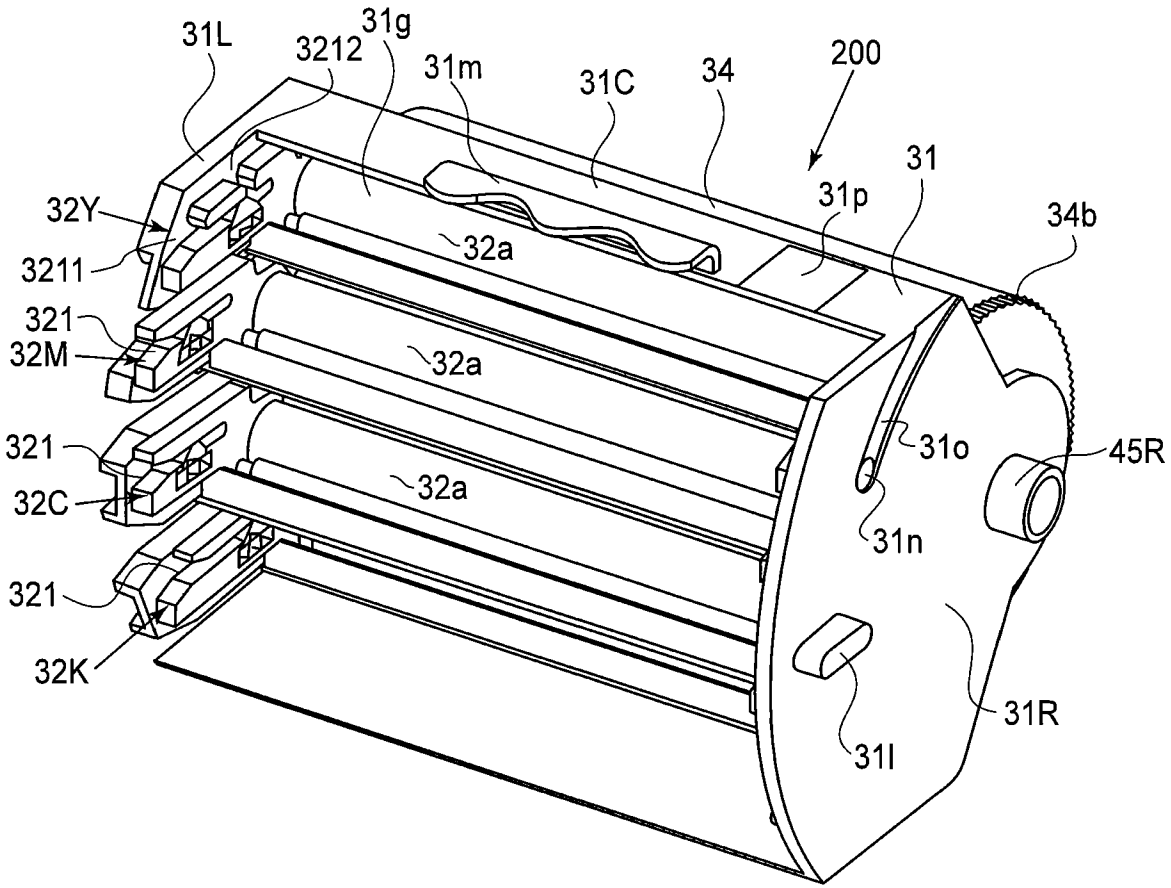

Referring to FIG. 6A and FIG. 6B, the structure of the unit 200 will be described. FIG. 6A shows a perspective view of the unit 200, as seen from the left-hand side, and FIG. 6B is a perspective view, as seen from the right-hand side. The unit 200 is provided with a sub-frame 31 detachably mountable relative to the main frame 110 of the main assembly 100A. A frame 31 supports the transfer member 34 rotatably. The transfer member 34 is rotatably supported at the left-hand end portion and the right-hand end portion of the center shaft (rotation shaft) 34*a* between a left side plate 31L and a right side plate 31R of the frame 31. A left shaft portion 45L and a right shaft portion 45R are fixed integrally to the outer surface of the side plates 31L, 31R co-axially with the center axis 34*a* of the transfer member 34. The right-hand end portion of the transfer member 34 is provided with a gear 34*b* which transmits the driving forces to the drums 32*a* to transmit the driving force transmitted from a main assembly driving source (unshown) to the drum gears 32*a*1. About the transfer member 34, the photosensitive member units 32 32Y, (32M, 32C and 32K) are disposed, so that the drums 32*a* are contacted to the transfer member 34. Each of the units 32 is positioned relative to the frame 31 by a positioning structure (unshown), and is fixed by screws or the like thereto. By this, the drum 32*a* and the transfer member 34 of each unit 32 can be positioned relative to each other with high precision. Each drum 32*a* is in contact to the transfer member 34 with a predetermined urging force. Each unit 32 is inserted and fixed in the direction of the arrow X1 relative to the frame 31. At this time, the removed developer discharging portion 32*f* provided at the left-hand end portion of each unit 32 is inserted into the frame 31 through the associated opening portion 31*k* provided in the left side plate 31L of the sub-frame 31. The discharging portion 32*f* is provided on the frame 31 in the state of projecting outwardly beyond the left side plate 31L. By providing the opening portion 31*k*, the discharging portion 32*f* which projects in the axial direction of the drum 32*a* can be mounted in the direction perpendicular to the axis of the drum 32*a*. The right side plate 31R of the frame 31 is provided with the portion-to-be-regulated 311 for regulating a rotation of the unit 200 in the main assembly 100A. The unit 200 is positioned in the main assembly 100A by the left shaft portion 45L, the right shaft portion 45R, and the portion-to-be-regulated 311. The details thereof will be described hereinafter. The left shaft portion 45L, the right shaft portion 45R, and a portion-to-be-regulated-in-rotation 311, which are the positioning portions for the transfer member 34 in the main assembly 100A is commonly provided on the frame 31. By this, the position of the transfer member 34 in the main assembly 100A is determined with high precision. In order to rotate the unit 200 within a predetermined angle range, a grip (second grip) 31*m* is provided in the upper portion of the frame 31. While gripping the grip 31*m*, the user can rotate or move the unit 200 between the image forming position (transfer position) (FIG. 1B, FIG. 2) for carrying out the image formation and the mounting and dismounting position B for mounting and demounting the cartridge 33 (FIGS. 10(*b*) and 14B). The image forming position A is the position for transferring the developer image onto the recording material S from the transfer member 34. The unit 200 can be rotated about Rotation axis (rotation axis) 34*a*. Here, the grip 31*m* is provided in the central portion (with respect to longitudinal direction) of a rotation axis 34*a* on the top surface (top plate 31C top) of the unit 200 (FIG. 6A, 6B). The right side plate 31R of the sub-frame 31 is provided with a portion-to-be-regulated-in-rotation 31*n* for regulating the rotation position, when the unit 200 rotates or moves upwardly by a predetermined angle. The portion-to-be-regulated 31*n* engages with the regulating portion 46 (FIG. 7, FIG. 8) of the main assembly (100A) as will be described hereinafter to be regulated in this position. The portion-to-be-regulated 31*n* is a through-hole (recess), and a cross-sectional configuration thereof is triangular (FIG. 8). The upper portion of the right side plate 31R extended to the portion-to-be-regulated 31*n* is provided with a guide portion 310 for guiding a rotation regulating portion 46. The guide portion 310 guides the regulating portion 46 to the portion-to-be-regulated 31*n*. The regulating portion 46 is a projection which has a triangular section configuration, and is engageable with the through-hole of the portion-to-be-regulated 31*n*. Here, the guide portion 310 is provided on an outside surface of the right side plate 31R, and is an elongated groove, which opens upward. The regulating portion 46 enters this groove and engages with the portion-to-be-regulated 31*n* by an end of this groove. A portion-to-be-urged 31*p* pressed by an elastic force of the unit urging spring (resilient member) 35 as will be described hereinafter provided on the cover 10 is provided to position the unit 200 in the main assembly 100A. The portion-to-be-urged 31*p* is provided on a top plate 31C which connects the left side plate 31L and the right side plate 31R with each other. As described above, each photosensitive member unit 32 fixed to the frame 31 is provided with a cartridge mounting portion 321 for dismountably mounting the cartridge 33. The mounting portion 321 for the cartridge 33Y is divided into a first mounting portion (mounting guide) 3211 and second mounting portion (mounting guide) 3212. The mounting portions 3211, 3212 are constituted by the mounting portion 321 of the unit 32Y, the left side plate 31L, and the right side plate 31R. A function of each mounting portion will be described hereinafter.

(Image Forming Unit Mounting Portion)

Figure 7:
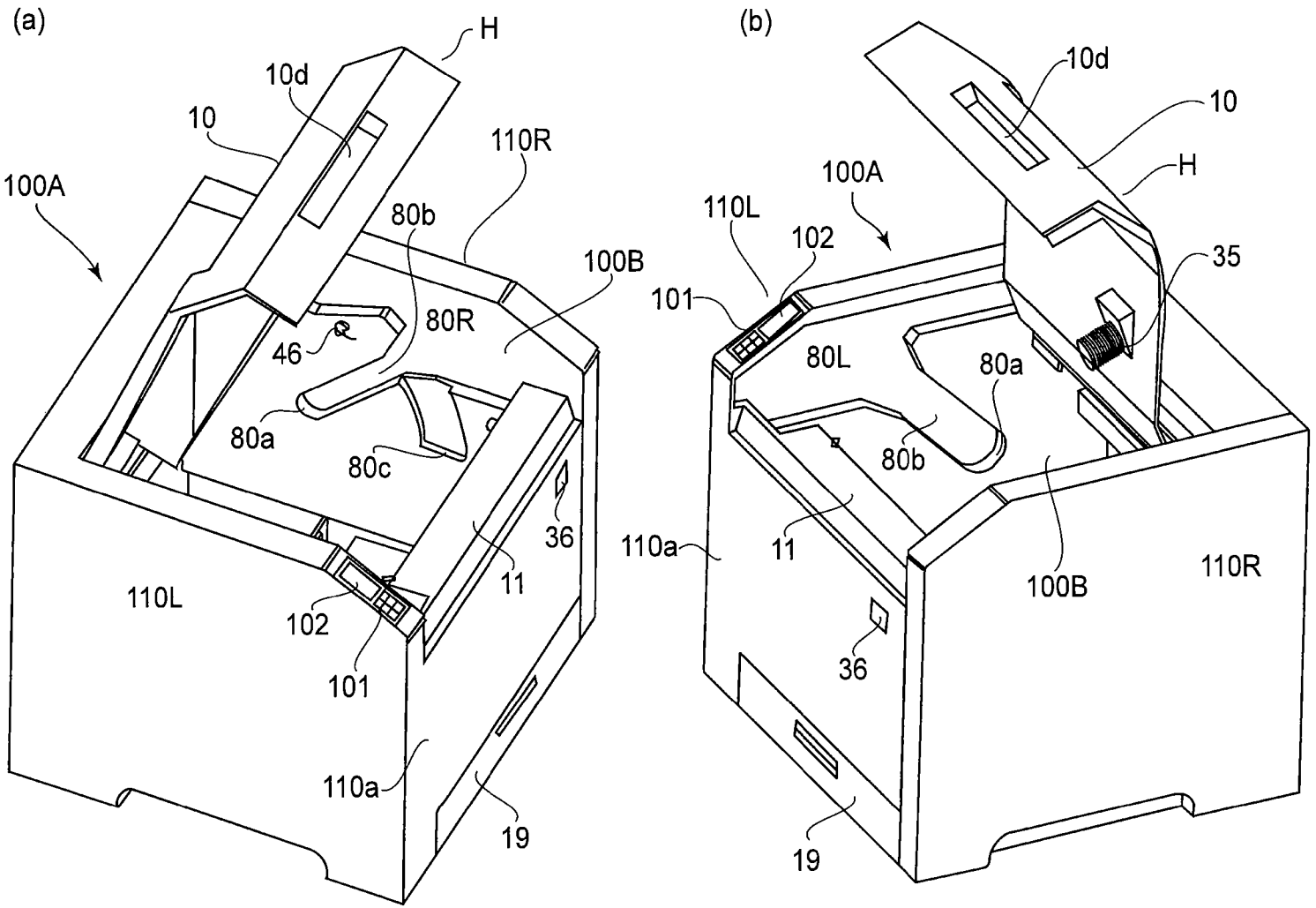
FIG. 7(*a*) is a left-hand side perspective view of a main assembly in the state where a cover is opened, and FIG. 7(*b*) is a right-hand side perspective view thereof.
Figure 8:
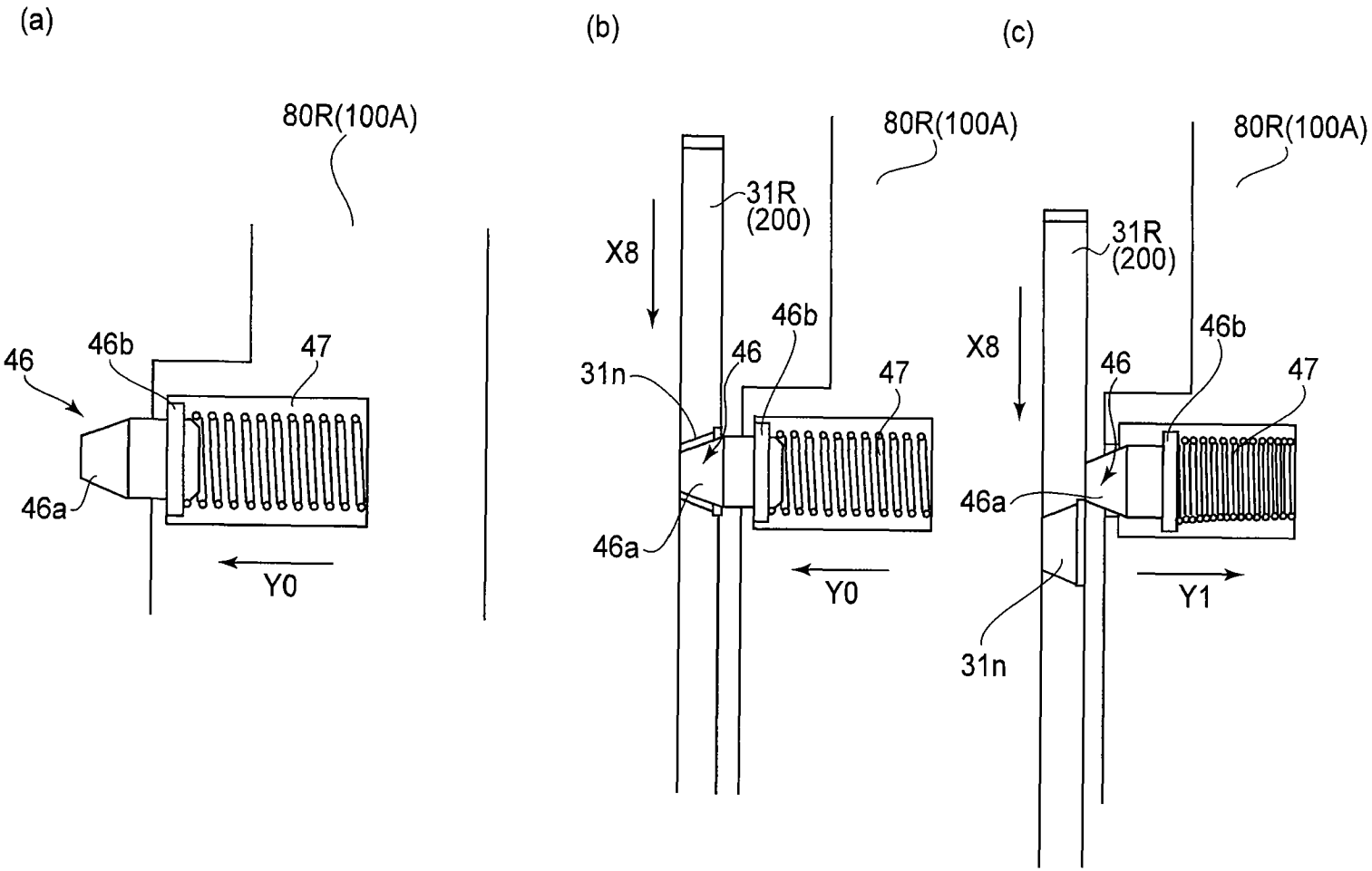
FIG. 8 is an illustration of a regulating portion and portion-to-be-regulated.

As shown in FIGS. 7(*a*) and 7(*b*), an inside of a frame 110L of the main assembly 100A is provided with the fixed left-hand side guiding plate 80L, and an inside of a frame 110R is provided with the fixed right-hand side guiding plate 80R. The guiding plates 80L, 80R oppose to each other. Each of the guiding plates 80L and 80R is provided with a positioning portion 80*a* for supporting the left and right shaft portions 45L and 45R of the frame 31 rotatably and a guide portion 80*b* for guiding the shaft portions 45L and 45R to the positioning portion 80*a*. The guiding plate 80R is provided with a rotation regulation portion 80*c* which is continuous of the guide portion 80*b*, and is contacted by the portion-to-be-regulated-in-rotation 311 provided on the unit 200 described above. In this manner, a regulating portion 80*c* limits the rotation of the unit 200. The upper portion of the guiding plate 80R is provided with the regulating portion 46 for regulating a rotational angle position of the unit 200 through the portion-to-be-regulated 31*n*, which is reciprocable. As shown in FIG. 8(*a*), a free end of the regulating portion 46 is provided with a tapered surface 46*a*. The regulating portion 46 is urged by the urging force of the urging member toward main assembly 100A inwardly in the direction of the arrow Y0. The regulating portion 46 is provided with a flange portion 46*b*, which prevents a disengagement from the guiding plate 80R. More particularly, the main assembly 100A is provided with the regulating portion 46 detachably engaged with the portion-to-be-regulated 31*n* provided in the unit 200. The unit 200 can be maintained in the mounting and dismounting position B by the portion-to-be-regulated 31*n* engaging with the regulating portion 46, in the state that the user's hand does not touch. The portion-to-be-regulated 31*n* is a projection, and engages with the recess, and the regulating portion 46 engages with the recess, and while the user grips the first grip 38 or a second grip 31*m*, the user rotates the unit 200 toward the mounting and dismounting position B from Image forming position (transfer position) A. In the state that the unit 200 reaches the mounting and dismounting position B, the projection engages with the recess by the elastic force of the spring (resilient member) 47. In this manner, the unit 200 is maintained at the mounting and dismounting position B, and at this time, the user can recognize the engagement of the projection to the recess by a tactile-response. When the user rotates the unit 200 toward the image forming position (transfer position) A from the mounting and dismounting position B, while griping the first grip 38 or the second grip 31*m*, the regulating portion 46 is disengaged from the portion-to-be-regulated 31*n* against the elastic force in interrelation with the rotation of the unit 200. The unit 200 is rotated toward Image forming position (transfer position) A. In this embodiment, the portion-to-be-regulated 31*n* is provided with a tapered surface 31*p* on an inner surface of the hole. The peripheral surface of the regulating portion 46 has the tapered surface 46*a*. Therefore, the portion-to-be-regulated 31*n* can engage smoothly with the regulating portion 46, and it can disengage therefrom smoothly.

(Mounting of Image Forming Unit)

Figure 9:
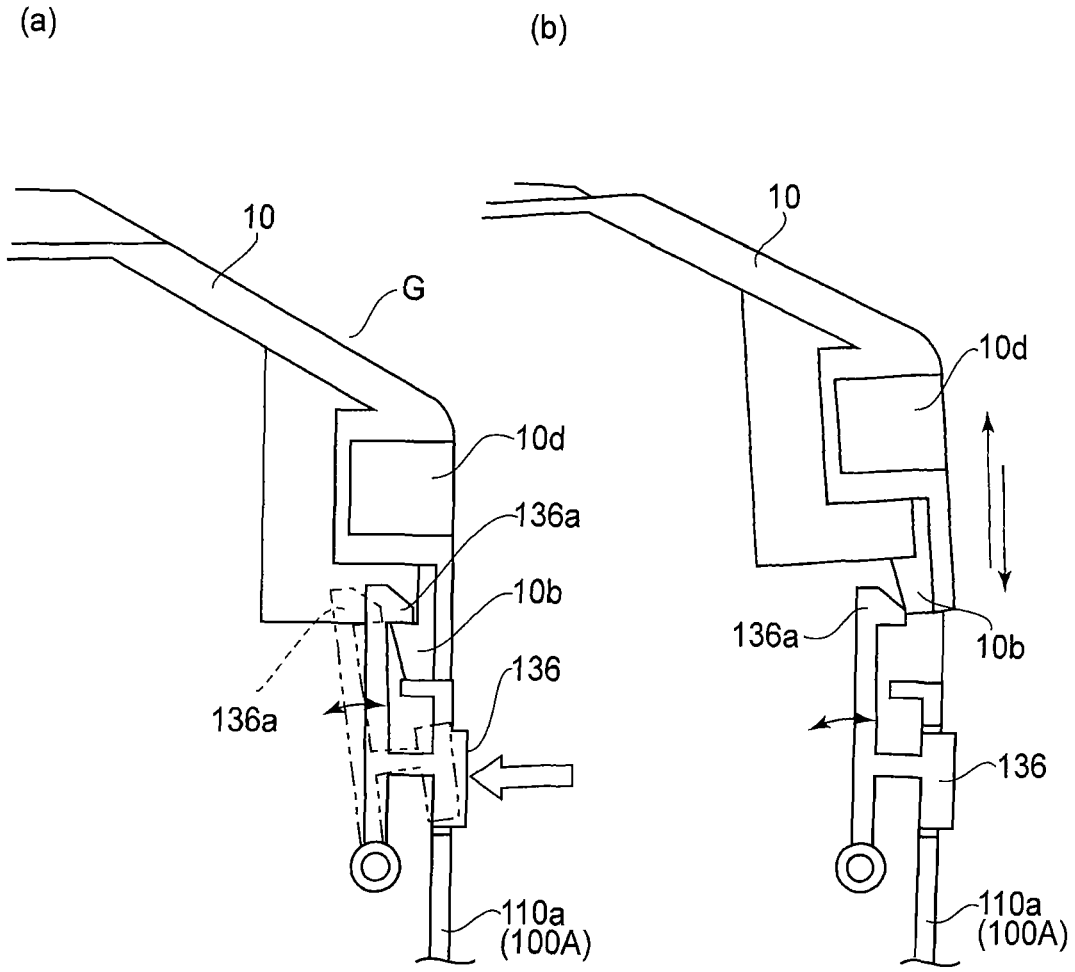
FIG. 9 is an illustration of a maintenance button.

The mounting of the unit 200 into the main assembly 100A will be described. The cover (opening and closing member) 10 is rotatably coupled to the main assembly 100A through a hinge shaft 10*a*. The cover 10 is movable between the closing position G for closing the opening portion 100B (FIG. 1B) and the open position H for opening the opening portion 100B (FIG. 7). The cover 10 is an opening and closing member which is rotatable for opening and closing the opening 100B in the upper portion of the main assembly 100A about the hinge shaft 10*a*. The closing position (closed position) of the cover 10 is maintained as follows. More particularly, as shown in FIG. 9(*b*), it is maintained by an engagement (latch engagement) between a locking claw portion (main assembly side locking portion) 36*a* provided in the maintenance button (36) provided on a front side of the main assembly 100A and the locking claw portion (opening and closing member side locking portion) 10*b* provided in the cover (10) side. The closure releasing of the cover 10 is carried out by pushing a button 36. When the button 36 is pushed rearwardly against the return spring (unshown), a claw portion 36*a* on the side of the button (36) escapes from a locking claw portion 10*b* of the cover 10 rearwardly, as shown by a chain line, so that the latching engagement is released (FIG. 9(*a*)). By this, the cover 10 is rotated to the open position H about the hinge shaft 10*a* to open the opening portion 100B greatly. In this embodiment, the claw portion 36*a* and a claw portion 10*b* elastically lock with each other releasably. However, this embodiment is not limited to this example. For example, the claw (locking portion) provided on one side may be elastically and releasably locked with the hole (locking portion) provided in another side.

Figure 10:
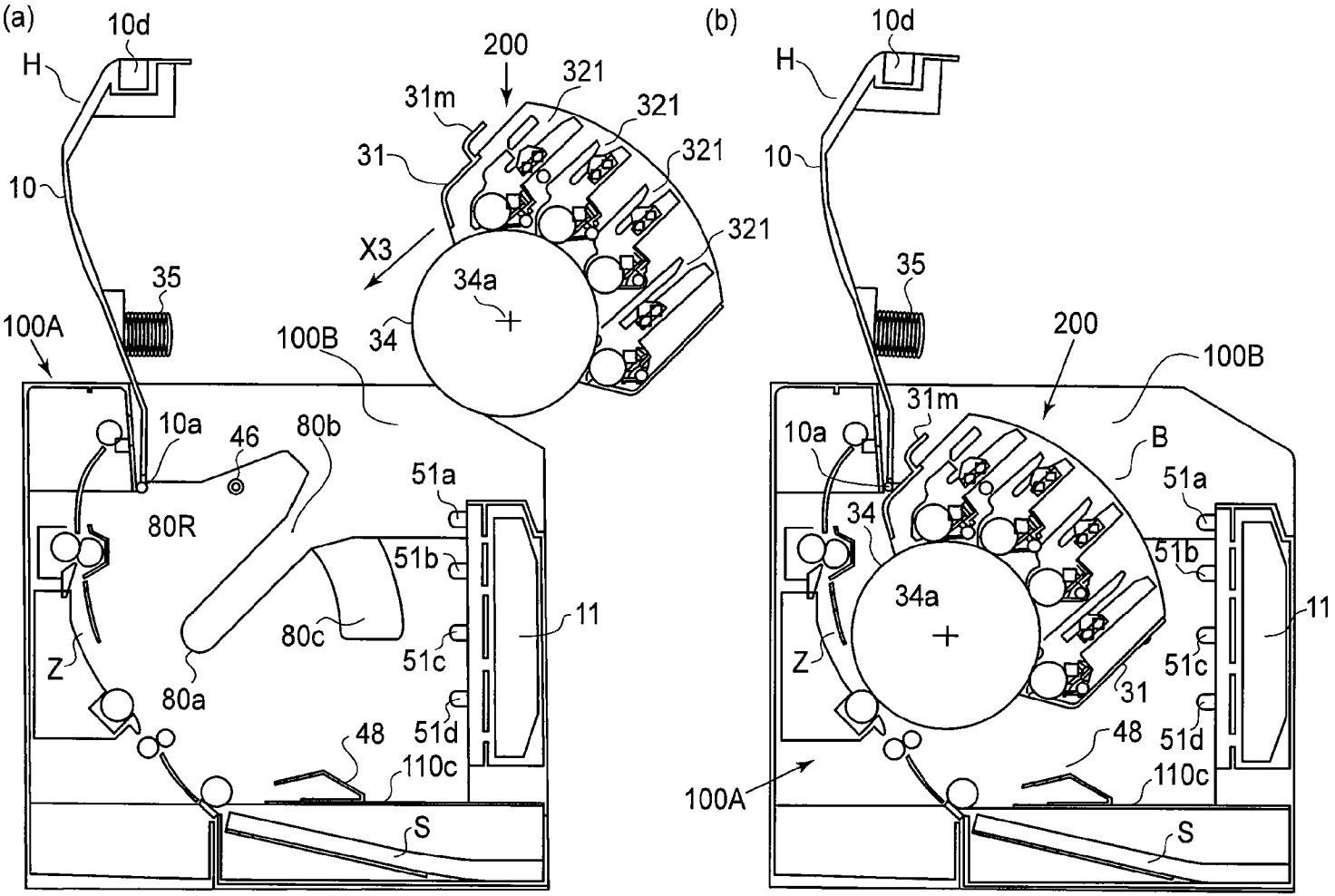
FIG. 10 is an illustration of the mounting of the image forming unit relative to the main assembly.
Figure 11A:
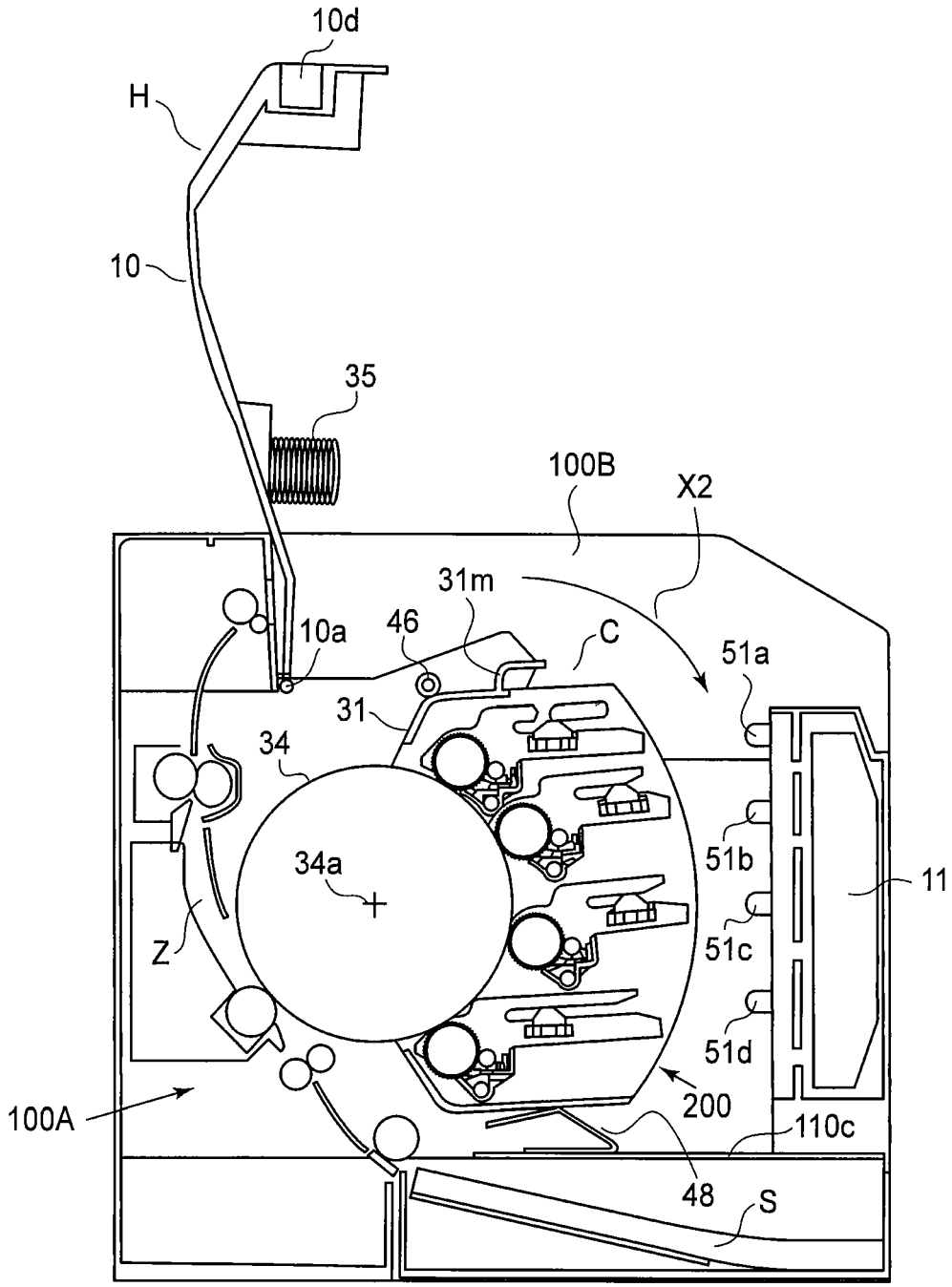
FIG. 11A is an illustration of the mounting of the image forming unit to the main assembly.

As shown in FIG. 10(*a*), for the mounting of the unit 200 into the main assembly 100A, the user rotates the cover 10 to the open position H to greatly open the opening portion 100B. The user inserts the unit 200 into the main assembly 100A from the opening portion 100B. The unit 200 is inserted and is mounted into the main assembly 100A, while a left-hand side shaft portion 45L and a right-hand side shaft portion 45R engage with the guide portions 80*b*. The guide portion 80*b* is provided in the guiding plates 80L, 80R. Thereafter, the shaft portions 45L, 45R are contacted to the positioning portion 80*a* provided on an extension of the guide portion 80*b* (FIG. 10(*b*)). At this time, the gear 34*b* (FIG. 6A, 6B) provided at the one-end portion of the transfer member 34 engages with a driving gear (unshown) provided in the main assembly 100A. Thereafter, the user grips the grip 31*m* and rotates the unit 200 in the direction of the arrow X2 (FIG. 11A). The lower portion of the main assembly, 100A with respect to the direction of the arrow X2 is provided with a spring (resilient member) 48 on the top surface of a lower stay 110*c* of the main frame 110. When the unit 200 rotates, a spring 48 is contacted to a lower surface of the frame 31 of the unit 200, and eases an impact caused by a rotational operation of the unit 200 by the elastic force. The unit 200 rotated in the direction of the arrow X2 is stopped by the elastic force of the spring 48, in the state where it is urged upwardly. Thereafter, the cover 10 is rotated to the closing position G to complete the mounting of the unit 200 into the main assembly 100A. More particularly, the unit 200 is rotatable about the shaft portions 45L and 45R, i.e., a rotational center 34*a* of the transfer member 34, between the left and right guiding plates 80L and 80R in the main assembly 100A. By this, the unit 200 is movable between the image forming position A (FIGS. 1A and FIG. 2) for carrying out the image forming operation and the mounting and dismounting position B for mounting and demounting the cartridge 33 (FIG. 10(*b*)). This will be described hereinafter. In the image forming position A, the laser beam L emitted from the scanner unit 11 is projected onto each drum 32*a*. The mounting and dismounting position B is retracted from the image forming position A, and the cartridge 33 can be mounted and demounted relative to the unit 200 without interfering with the scanner unit 11. In this embodiment, the unit 200 faces the scanner unit 11 in the image forming position (transfer position) A. In the mounting and dismounting position B, the unit 200 retracts upwardly from the scanner unit 11.

(Residual Developer Container)

Figure 11B:
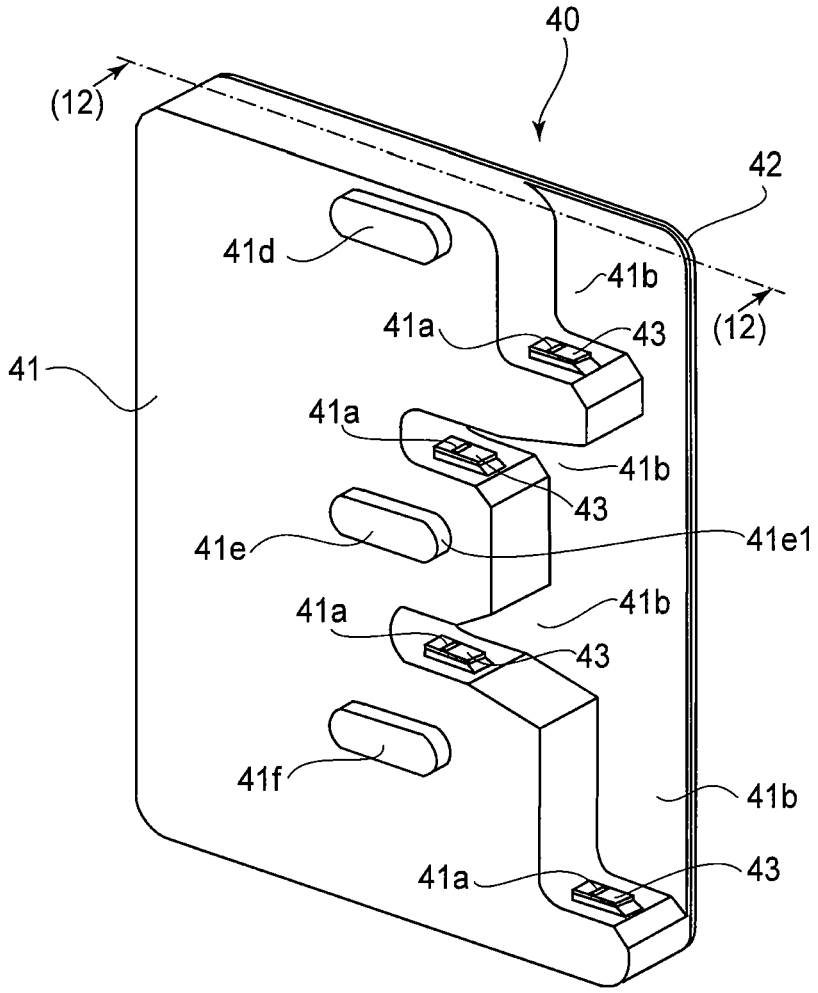
FIG. 11B is a right-hand side perspective view of the residual developer container.
Figure 12:
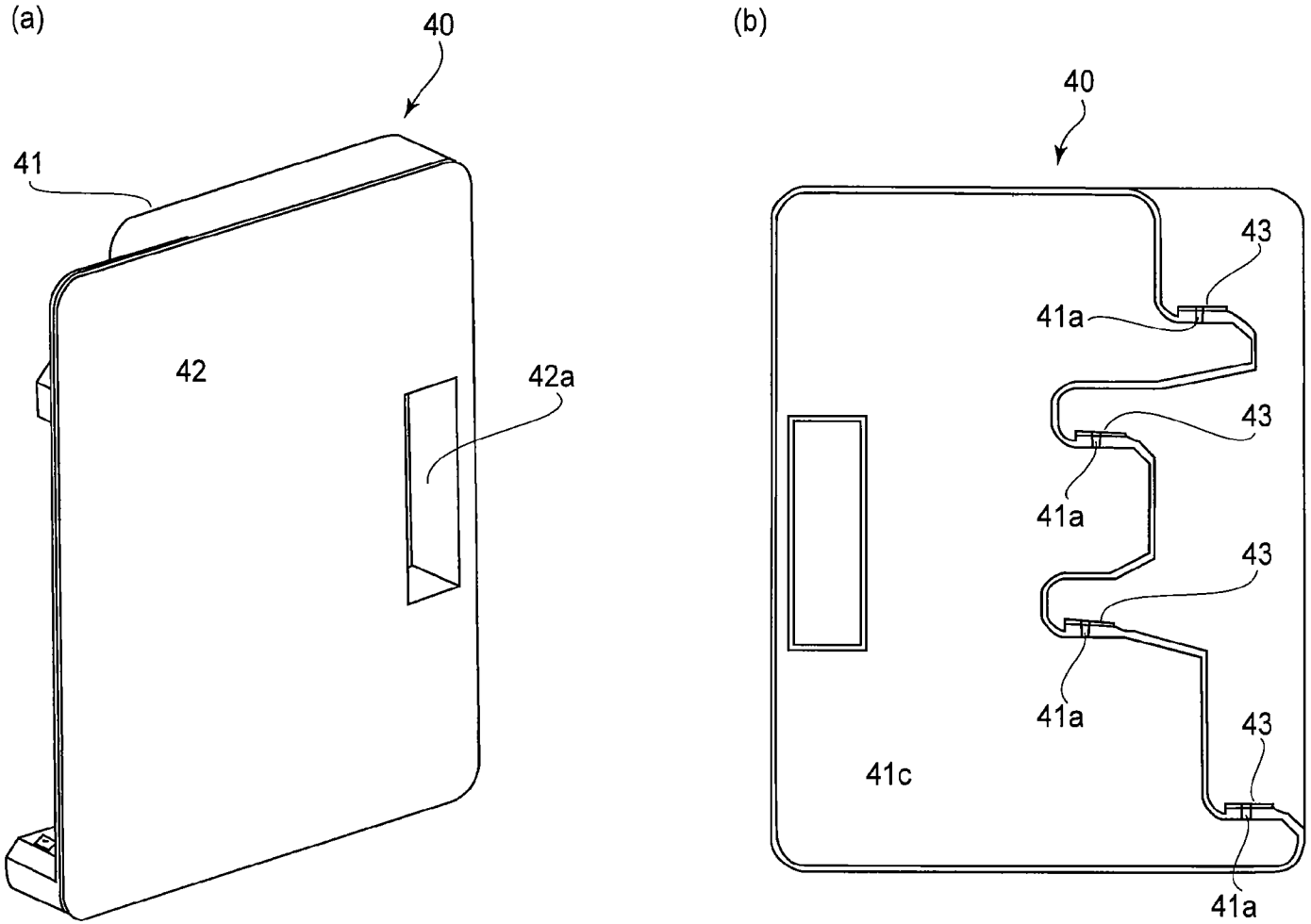
FIG. 12(*a*) is a left-hand side perspective view of the residual developer container, and 12(*b*) is a sectional view taken along the line (12)-(12) of FIG. 11B.

FIG. 11B is a right-hand side perspective view of the residual developer container (removed developer accommodating portion) 40, FIG. 12(*a*) is a left-hand side perspective view, and FIG. 12(*b*) is a sectional view taken along a line (12)-(12) of FIG. 11B. As described above, in each of the photosensitive member units 32 (32Y, 32M, 32C and 32K), the developer which remained on the surface of the drum 32*a* is removed by the cleaning blade (cleaning member) 32*c*. The removed developer is fed in the feeding direction by the feeding screw (developer feeding member) 32*e*. The fed residual developer (removed developer) is contained in the container 40 provided at the left-hand end portion of the unit 200 which is in the downstream side with respect to the feeding direction of the screw 32*e*. The container (removed developer accommodating portion) 40 includes an accommodating container portion (accommodating portion) 41 and a cover 42, which are integrated with each other by welding or the like. The container part 41 is provided with a removed developer receiving opening 41*a* corresponding to the unit 32. Each opening 41*a* is provided in the recess 41*b* formed on the container 41. A recess 41*b* has a sufficient size permitting the passage of the removed developer discharging portion 32*f* of the unit 32. The circumference of each opening 41*b* is provided with a sealing member 43 for preventing the developer from outwardly scattering by contacting the discharging portion 32*f*. The sealing member 43 is fixed by double coated tape or the like to the container part 41. The sealing member 43 is provided with the opening having substantially the same size as that of the opening 41*a*. An accommodating portion 41*c* is provided below the opening 41*a*, and it contains the removed developer received through the opening 41*a*. A right side of the container part 41 is provided with portions-to-be-guided 41*d*-41*f* for facilitating mounting the container 40 to the unit 200. The container 40 is mounted and positioned to the unit 200 through the portions-to-be-guided 41*d*-41*f*. The cover 42 is provided with the grip 42*a* for mounting and demounting the container 40 relative to the unit 200. The grip 42*a* is provided by forming a recess in the cover 42. When an amount of the removed developer more than a predetermined amount is contained in the container 40, the user grips the grip 42*a* and dismounts the container 40 from the unit 200. The user replaces it with a new container 40. Or, after the removed developer in the container 40 is discarded, the container 40 may be re-used.

(Mounting to Image Forming Unit of Removed Developer Container)

Figure 13:
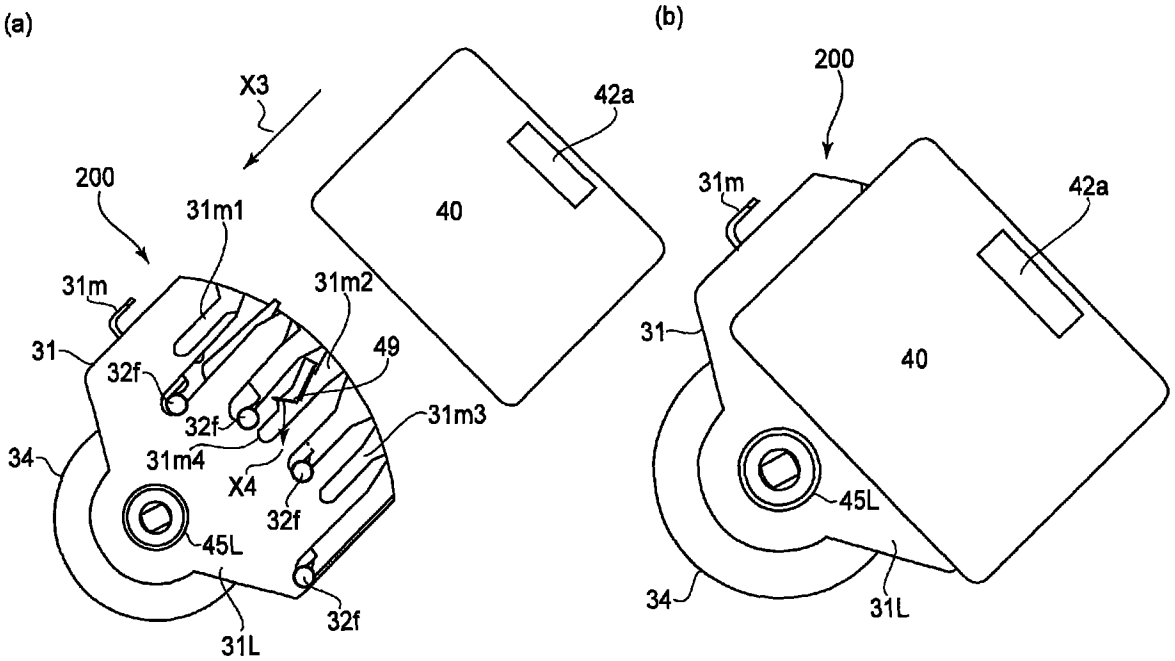
FIG. 13 is an illustration of the mounting and demounting of the residual developer container relative to the image forming unit.

The container 40 is mounted and demounted in the state that the unit 200 is placed in the mounting and dismounting position B (FIG. 10(*b*)). As shown in FIG. 6A, or FIG. 13(*a*), the outside surface of the left side plate 31L of the sub-frame 31 is provided with guide portions 31*m*1-31*m*3. The portions-to-be-guided 41*d*-41*f* provided in the container 40 are inserted in the direction of the arrow X3 into the guide portions 31*m*1-31*m*3 respectively. In the guide portion 31*m*2, the leaf spring (urging member, resilient member) 49 is provided. After receiving the portion-to-be-guided 41*e*, a spring 49 elastically urges the portion-to-be-guided 41*e* in the direction of the arrow X4. By urging to the spring 49, the portion-to-be-guided 41*e* contacts the portion to be positioned (FIG. 11B) 41*e*1 thereof to a positioning portion 31*m*4 provided at a trailing end of a guide portion 31*m*2. In this manner, the portion-to-be-guided 41*e* is positioned with respect to the front-rear direction. The width (with respect to up-down direction) of the portion-to-be-guided 41*e* is substantially the same as the width (with respect to up-down direction) of the guide portion 31*m*2. In this manner, the portion-to-be-guided 41*e* is simultaneously positioned also in the up-down direction. Furthermore, the portion-to-be-guided 41*e* is prevented from the movement in the direction opposite to the direction of the arrow X3 by the elastic force of the spring 49. Therefore, the container 40 does not separate during the rotational operation of the unit 200. As has been described in the foregoing, the container 40 is mounted and demounted relative to the unit 200 (FIG. 13(*b*)). By a series of mounting operations, the shutter 32*g* provided in each unit 32 is moved to the open position by an actuator (unshown). When the mounting is completed, the opening 41*a* provided in the container 40 opposes to the opening 32*g*1 provided in the unit 32. The container 40 receives the removed developer fed by the feeding screw (feeding member) 32*e* through the openings 32*g*1, 41*a*.

In exchanging the container 40, as described above, while the user grips the grip 42*a*, the user dismounts the container 40 from the unit 200. In the state where the unit 200 is placed in the mounting and dismounting position B, the container 40 can be exchanged in the same position as the mounting and dismounting position B of the cartridge 33 as will be described hereinafter. In response to the operation which dismounts the container 40, an opening of the unit 32 is shut by a spring member (resilient member) of the shutter 32*g*. On the other hand, the member such as a shutter is not provided for the opening 41*a* of the container 40 in order to reduce cost. However, in the movement in a mounting and demounting direction (the direction of arrow X3 in FIG. 13(*a*), and the opposite direction thereto) of the container 40, the opening 41*a* does not face downwardly, and therefore, the leakage of the removed developer is sufficiently suppressed without a shutter and so on. The container 40 can be mounted and demounted relative to the unit 200, and therefore, the user can carry out the exchange of the cartridge 33 and the exchange of the container 40 through the same process. Therefore, usability is improved. The mounting and demounting direction of the container 40 and the mounting and demounting direction of the cartridge 33 as will be described hereinafter are the same, and therefore, the user can carry out those operations easily. Here, the same direction is not in the strict sense, but the directions may slightly be deviated, if the mounting and demounting of the container 40 and the cartridge 33 can be performed, without changing the position of the unit 200. The guide portion 31*m*1-31*m*3 of the unit 200 for mounting the container 40 is provided on the outside surface of the sub-frame 31. Therefore, it is not necessary to provide the accommodating space for accommodating the container 40 in the sub-frame 31, and therefore, the downsizing of a device can be accomplished. The mounting position for the container, 40 is provided in the non-driving side which is the side opposite from the driving side which is provided with the driving system (driving force transmitting portion) of the drum gear 32*a*1 and the feeding gear 32*f* or the like with respect to the axial direction of the drum 32*a*. Therefore, the latitude in the disposition of the driving system is enhanced, and as a result, the downsizing of the device is accomplished.

(Mounting of Cartridge)

The mounting and demounting of the cartridges 33 (33Y, 33M, 33C and 33K) relative to the unit 200 is carried out in the state that the unit 200 is placed in mounting and dismounting position B (FIG. 10(*b*)). First, the cover 10 is moved to the open position which opens the opening portion 100B from the closing position which closes the opening portion 100B (FIG. 11A). Then, while griping the grip 31*m* provided by the unit 200, the user rotates the unit 200 to the mounting and dismounting position B (FIG. 10(*b*)). By the above-described rotational operation, the unit 200 is rotated upwardly by a predetermined angle. In this manner, the regulating portion 46 provided in the main assembly 100A engages with the portion-to-be-regulated 31*n* provided on the frame 31. At this time, the unit 200 is regulated by the regulating portion 46 in the mounting and dismounting position B. In other words, the unit 200 is temporarily fixed in the mounting and dismounting position B, and is prevented from the movement toward the image forming position A. Since the unit 200 is regulated in the mounting and dismounting position B, the user can carry out a mounting and dismounting operation of the cartridge 33, while keeping the hand off the grip 31*m*. Therefore, the usability is satisfactory. The regulating portion (projection regulating portion) 46 is an L-shaped projection, and it engages with the portion-to-be-regulated (recessed portion-to-be-regulated) 31*n* which is the L-shaped recess. In this manner, the unit 200 which has reached the mounting and dismounting position is prevented from the downward movement even in the state that the user has lifted the hand. More particularly, in the state that the unit 200 reaches the mounting and dismounting position B, the projected regulating portion 46 engages with the recessed portion-to-be-regulated 31*n* by an elastic force of a spring 47. In this manner, the unit 200 maintains the mounting and dismounting position B, even if the user lifts the hand off. However, when moving the unit 200 from the mounting and dismounting position B to the image forming position A, when the user lightly pushes the unit 200 downwardly, the engagement separates smoothly. In this manner, the regulating portion 46 separates from the portion-to-be-regulated 31*n* to move the unit 200 downwardly. More particularly, when the user rotates the unit 200 toward the image forming position A, while gripping the grip 38 or the grip 31*m*, the regulating portion 46 is disengaged from the portion-to-be-regulated 31*n* against the elastic force of the spring 47 in interrelation with the rotation of the unit 200. This is because an engagement part between the regulating portion 46 and the portion-to-be-regulated 31*n* is the tapered surface (FIG. 8). A taper 31*p* is a tapered surface of the portion-to-be-regulated 31*n*, and a taper 46*a* is a tapered surface of the regulating portion 46.

Figure 14A:
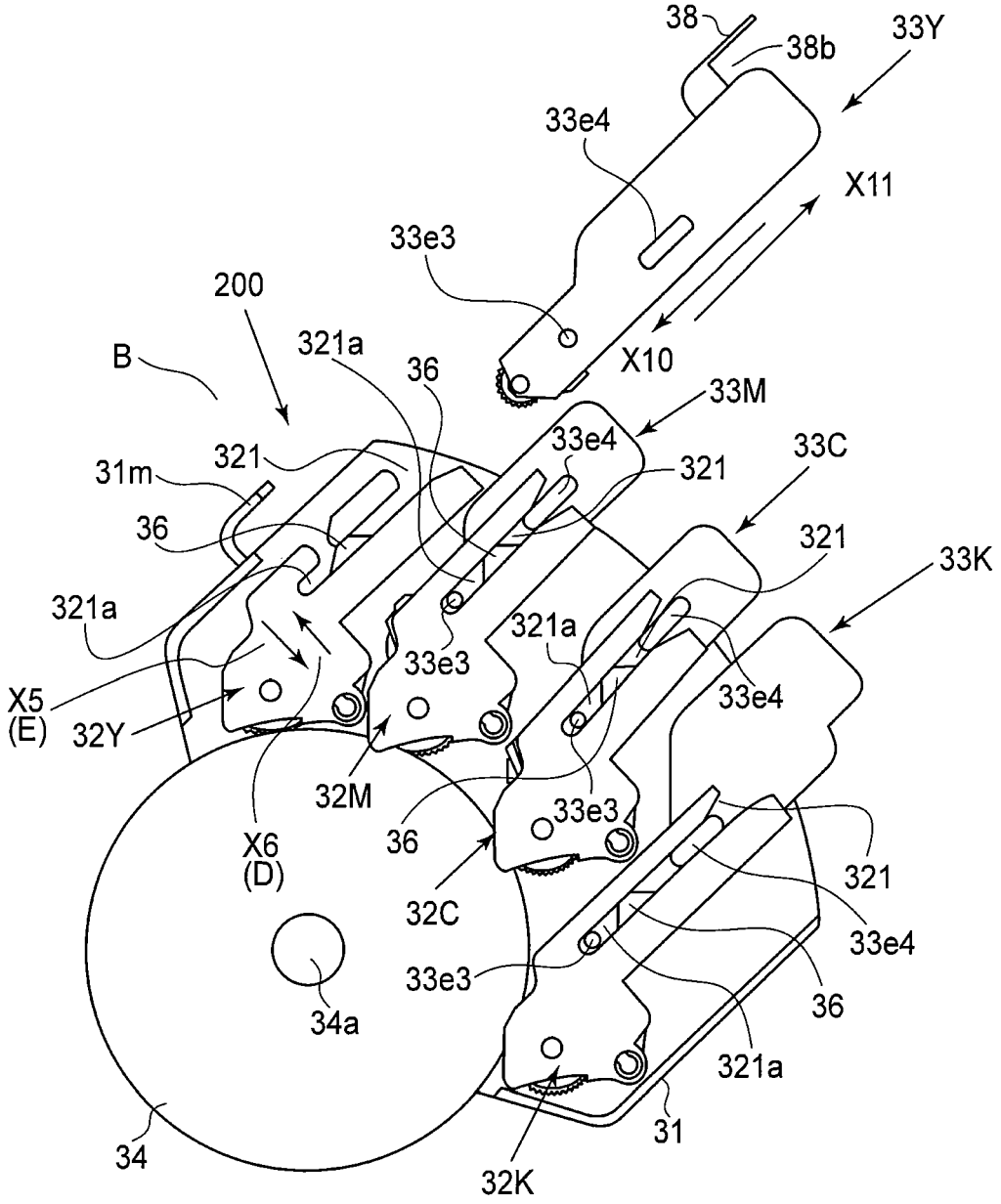
FIGS. 14A and 14B are illustrations of the mounting and demounting of the cartridge relative to the unit.
Figure 18:
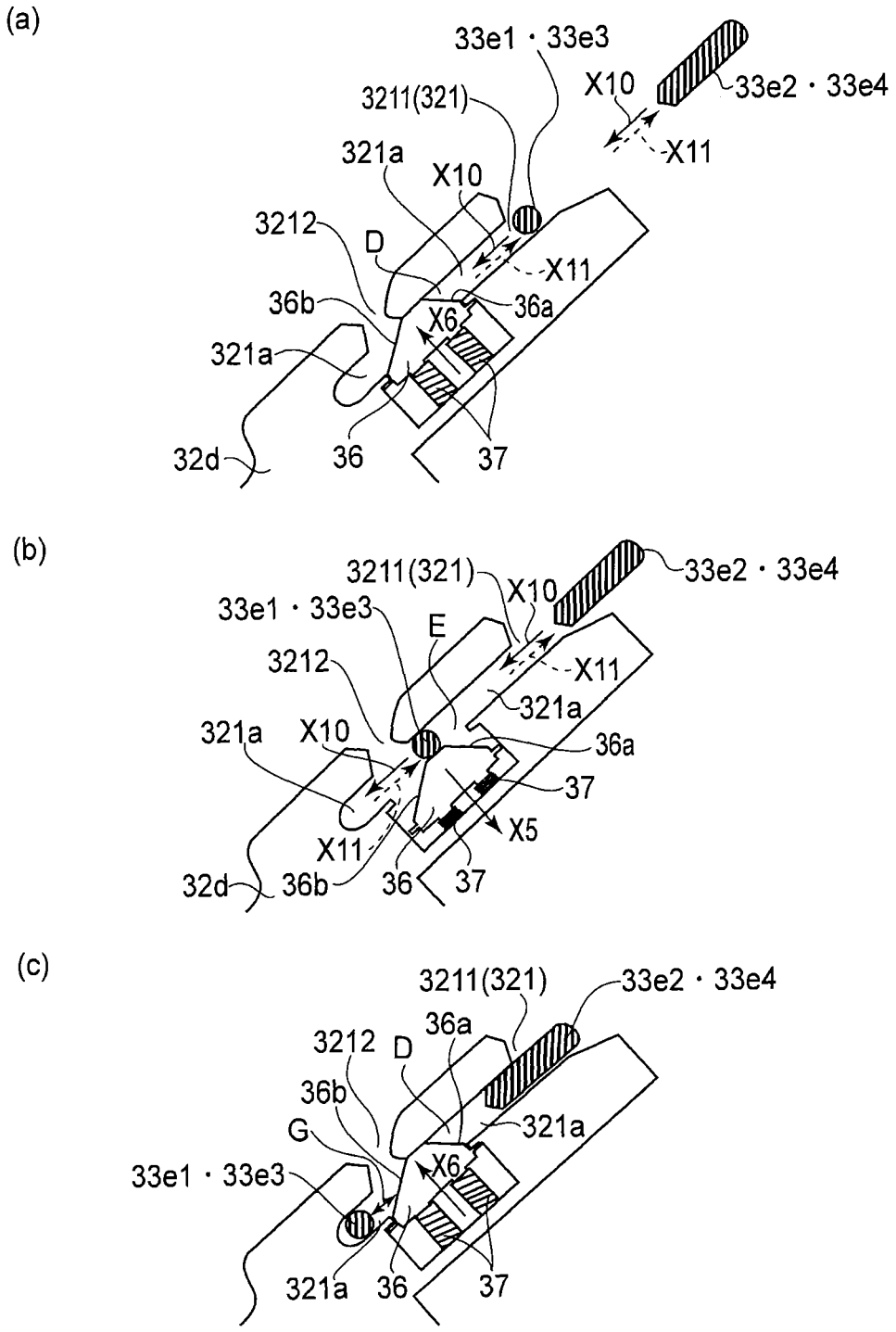
FIGS. 18(*a*) through 18(*c*) are illustrations of the mounting and demounting of the cartridge relative to the unit.

At first, the user grips a first grip 39 (FIG. 2) provided on the cartridges 33 33M, (33C and 33K) and a part of developing device cases 33*a*. With respect to the cartridge 33Y, the user grips the first grip 39 and the flat surface portion 38*a* (FIG. 5) of a second grip 38. Or, the user grips only the second grip 38. Each cartridge 33 is mounted to the corresponding mounting portion 321 of the unit 200. The mounting direction is the direction (mounting direction) perpendicular to a rotational axis direction of a developing roller 32*b*. More particularly, as shown in FIG. 14A, and (a) of FIG. 18, the portions-to-be-guided 33*e*1, 33*e*3 in the side of the cartridge (33) is inserted into the mounting portion 321 of a unit (200). FIG. 14A, and FIG. 18(*a*) show the case of the mounting of the cartridge 33Y. In the case of the mounting of the cartridge 33Y, it is inserted into a first mounting portion 3211. Subsequently, the portions-to-be-guided 33*e*2, 33*e*4 is inserted. The portion-to-be-guided 33*e*1-33*e*4 is guided by the mounting portion 321, and it is inserted into the inside toward the drum 32*a*. The portions-to-be-guided 33*e*1, 33*e*3 are abutted to the regulating member 36 provided in the mounting portion 321. The regulating member 36 in this embodiment is an L-shape member, and the portions-to-be-guided 33*e*1, 33*e*3 are abutted to the L-shape portion. In the free state of the regulating member 36, the regulating member 36 is raised by the urging force of the urging member 37, so that an L-shape portion enters the recess 321*a* of the mounting portion 321. The top surface of the regulating member 36 abuts to a ceiling surface of the recess 321*a* and is stopped thereby (FIG. 18). The pushing-up position of the regulating member at this time 36 is a regulation position D. Furthermore, when the cartridge 33 is further inserted, the portions-to-be-guided 33*e*1, 33*e*3 apply the depression force against the urging force of the urging member 37 which urges the regulating member 36. By this, the regulating member 36 is reduced in the direction of the arrow X5. The portions-to-be-guided 33*e*1, 33*e*3 enter between the top surface of the regulating member 36 and the ceiling surface of the recess 321*a* (FIG. 18(*b*)). The push down position of the regulating member at this time 36 is a permission position E, wherein the mounting and demounting of the cartridge 33 is permitted. In this manner, the portions-to-be-guided 33*e*1 and 33*e*3 enter a rear side of the recess 321*a* beyond the regulating member 36. The portions-to-be-guided 33*e*2 and 33*e*4 also enter the recess 321*a* of the mounting portion 321 (FIG. 18(*c*)). By this, the mounting, into the unit 200, of the cartridge 33 is completed. When the portions-to-be-guided 33*e*1 and 33*e*3 pass, the regulating member 36 is again moved in the direction of the arrow X6 which is the direction opposite to the direction of the arrow X5 by the urging force (elastic force) of the spring (urging member, resilient member) 37. The regulating member 36 returns to the previous regulation position D. The user depresses the regulating member 36 against the urging force of the urging member 37, and the regulating member 36 further returns to the previous regulation position D, so that the urging force is released. In this manner, the user can feel a moderate mounting tactile. In this state, the portions-to-be-guided, 33*e*1 and 33*e*3 are prevented from the movement toward the upstream side with respect to the mounting direction by the regulating member 36. Therefore, even if the cartridge, 33 tends to move toward the upstream side with respect to the mounting direction, the regulating member 36 prevents the movement thereof. Therefore, the cartridge 33 does not disengage from the unit 200. The position of the regulating member 36 at the time of the regulating member 36 permitting the mounting of the cartridge 33 is a permission position E, wherein the regulating member 36 has been pushed down in the direction of the arrow X5. The position at the time of regulating the movement of the cartridge 33 is a regulation position D (FIG. 14A). More particularly, the regulating member 36 prevents the cartridge 33 mounted to the mounting portion 231 from moving outwardly of the unit 200, when the unit 200 moves between the image forming position A and the mounting and dismounting position B. The regulating member 36 is movable between the regulation position D for regulating the movement of the cartridge 33 outward of the unit 200 and the permission position E for permitting the mounting and demounting of the cartridge 33 relative to the mounting portion 321. The regulating member 36 is placed in the regulation position D, when the unit 200 moves between the image forming position A and the mounting and dismounting position B. The cartridge 33 is provided with the portion-to-be-guided (portions-to-be-regulated) 33*e*1 and 33*e*3 regulated by the regulating member 36. The unit 200 is provided with the spring (urging member) 37 which urges the regulating member 36 to the regulation position D. In the state that the portions-to-be-guided 33*e*1 and 33*e*3 are regulated by the regulating member 36, a gap G (FIG. 18, FIG. 19) is provided between the regulating member 36 and the portions-to-be-guided 33*e*1 and 33*e*3, so that n the regulating member 36 and the portions-to-be-guided 33*e*1 and 33*e*3 do not contact to each other. The movement of the cartridge 33 relative to the unit 200 is limited within the limits of the gap G. Therefore, the cartridge 33 is not interfered by the regulating member 36, and therefore, it is not influenced by the elastic force of the regulating member 36, and is pressed to the developing roller 33*b* by the elastic force of the urging member (resilient member) 51. In this embodiment, the portions-to-be-guided 33*e*1 and 33*e*3 function also as the portions-to-be-regulated regulated by the regulating member 36, and therefore, the mounting and demounting of the cartridge 33 relative to the mounting portion 321 is smooth. The regulating member 36 can prevent the cartridge 33 assuredly from the movement exceeding the predetermined range outwardly of the unit 200. The elastic force of the spring (urging member) 37 is sufficient to maintain the regulating member 36 at the regulation position D, when the unit 200 moves between the image forming position A and the mounting and dismounting position B. The elastic force is such as to permit the movement of the regulating member 36 to the permission position E, when the user mounts and demounts the cartridge 33 relative to the mounting portion 321. The regulating member 36 is provided with a first ascending inclined surface 36*a* which rises in the mounting direction X10 of the cartridge 33 to the mounting portion 321 and a second ascending inclined surface 36*b* which rises in a removing direction X11 (Y5) which is the direction opposite from the mounting direction X10 (Y6). The inclined surface 36*a* and the inclined surface 36*b* are provided in this order in the mounting direction X10

Figure 19:
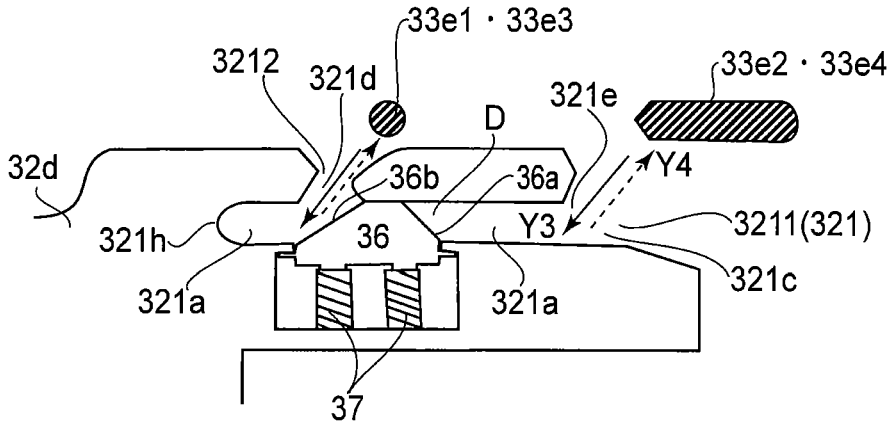
FIGS. 19(*a*) through 19(*c*) are illustrations of the mounting and demounting of the cartridge relative to the unit.
Figure 19:
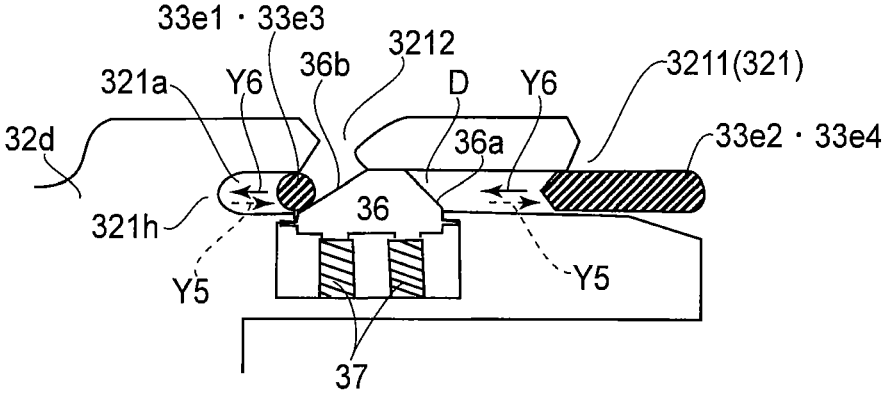
Figure 19:
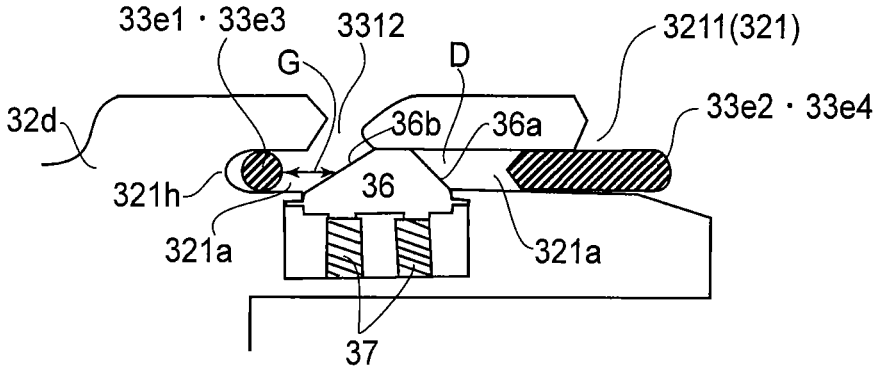

(FIG. 18, FIG. 19). More particularly, in the mounting direction X10 (Y6), the inclined surface 36*a* is provided in the upstream, and the inclined surface 36*b* is provided downstream. With such a structure, the inclined surface 36*b* can regulate the movement, beyond a predetermined range, of the cartridge 33 (portions-to-be-guided 33*e*1 and 33*e*3) assuredly. The removal and mounting of the cartridge 33 relative to the mounting portion 321 are smooth. This is because, the portions-to-be-guided 33*e*1 and 33*e*3 engage assuredly with the inclined surfaces 36*a*, 36*b* to push the inclined surfaces 36*a*, 36*b* down. The portions-to-be-guided (portions-to-be-regulated) 33*e*1 and 33*e*3 includes a projection provided at the outside of one longitudinal end of the developing roller 33*b*. In this embodiment, the projection is provided also at the outside of the other longitudinal end. The regulating member 36 and the spring 37 are provided at each of one-end portion and the other end portion of the unit 200 with respect to the direction perpendicular to the mounting direction to the mounting portion 231. The cartridge 33 is prevented from the movement outward of the unit 200 by the one longitudinal end portion and the other end portion. The cartridge 33 is mounted to the unit 200 in the state that the portions-to-be-guided (portions-to-be-regulated) 33*e*1 and 33*e*3 are movable in the recess 321*a*. In this manner, when the user mounts the cartridge 33 into the unit 200, the rough mounting is satisfactory. In other words, the cartridge 33 may not be positioned relative to the unit 200 in the mounting and dismounting position B. Therefore, the mounting operation of the cartridge 33 relative to the unit 200 is simple and easy. In this embodiment, the regulating member 36 is provided in the unit 200. However, the regulating member may be provided outside the unit 200. The regulating member 36 may be provided in any proper position, if the disengagement of the cartridge 33 from the unit 200 can be prevented.

The regulating member 36 functions to substantially prevent the cartridge 33 from moving outwardly of unit 200 when the unit 200 is moved between the transfer position and the mounting and demounting position.

However, the substantial prevention does not mean that the movement is completely prevented, but may be movable within a limited range.

In addition, the case in the state that the cartridge 33 is mounted to the mounting position 32 in the normal manner, a part of the cartridge is outside the unit 200 is not excluded.

When the unit 200 moves (rotates), the cartridge may be moved within a range in which the cartridge 33 contacts a member provided in the main assembly 100A.

(Movement, to Image Forming Position, of Image Forming Unit)

Figure 14B:
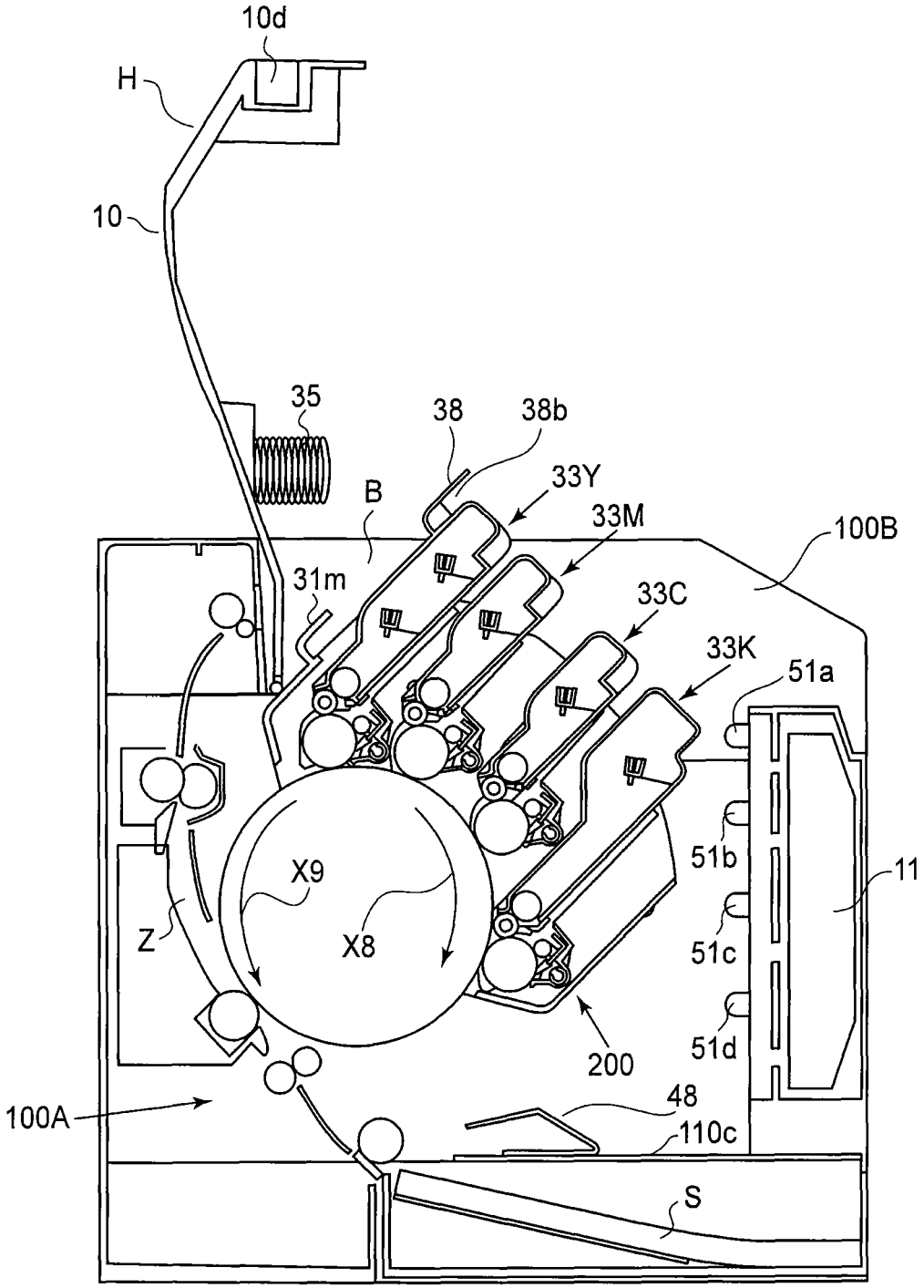

As shown in FIG. 14B, when the mounting of each cartridge 33 relative to the unit 200 is completed, the user rotates the unit 200 toward the image forming position A. First, the user grips the second grip 38 of the cartridge 33Y of the topmost stage of the unit 200, or grips the grip (second grip) 31*m* provided on the sub-frame 31 of the unit 200, and the user applies the force in the direction of the arrow X8 to the unit 200. The regulating portion 46 disengages from the portion-to-be-regulated 31*n*, and the unit 200 becomes rotatable. As shown in FIG. 8(*b*), the regulating portion 46 and the portion-to-be-regulated 31*n* are provided with the surfaces inclined relative to the arrow X8 which is the rotational direction of the unit 200. As shown in FIG. 8(*c*), by the rotational operation in the direction of the arrow X8 the portion-to-be-regulated 31*n* retracts the regulating portion 46 in the direction of the arrow Y1. In this manner, the unit 200 is rotated. The spring (resilient member) 47 for urging a regulating member 46 in the direction of the arrow Y0 is provided with an elastic force exceeding a predetermined elastic force (urging force). By this, the portion-to-be-regulated 31*n* does not separate from the regulating portion 46 in the mounting and demounting operation of the cartridge 33 in the mounting and dismounting position B of the unit 200. On the other hand, the regulation is released by the rotational operation by the user, because of the proper selection of the urging force The unit 200 is rotated about the left shaft portion 45L and the right shaft portion 45R in the state of being supported by the positioning portion 80*a*.

Figure 20:
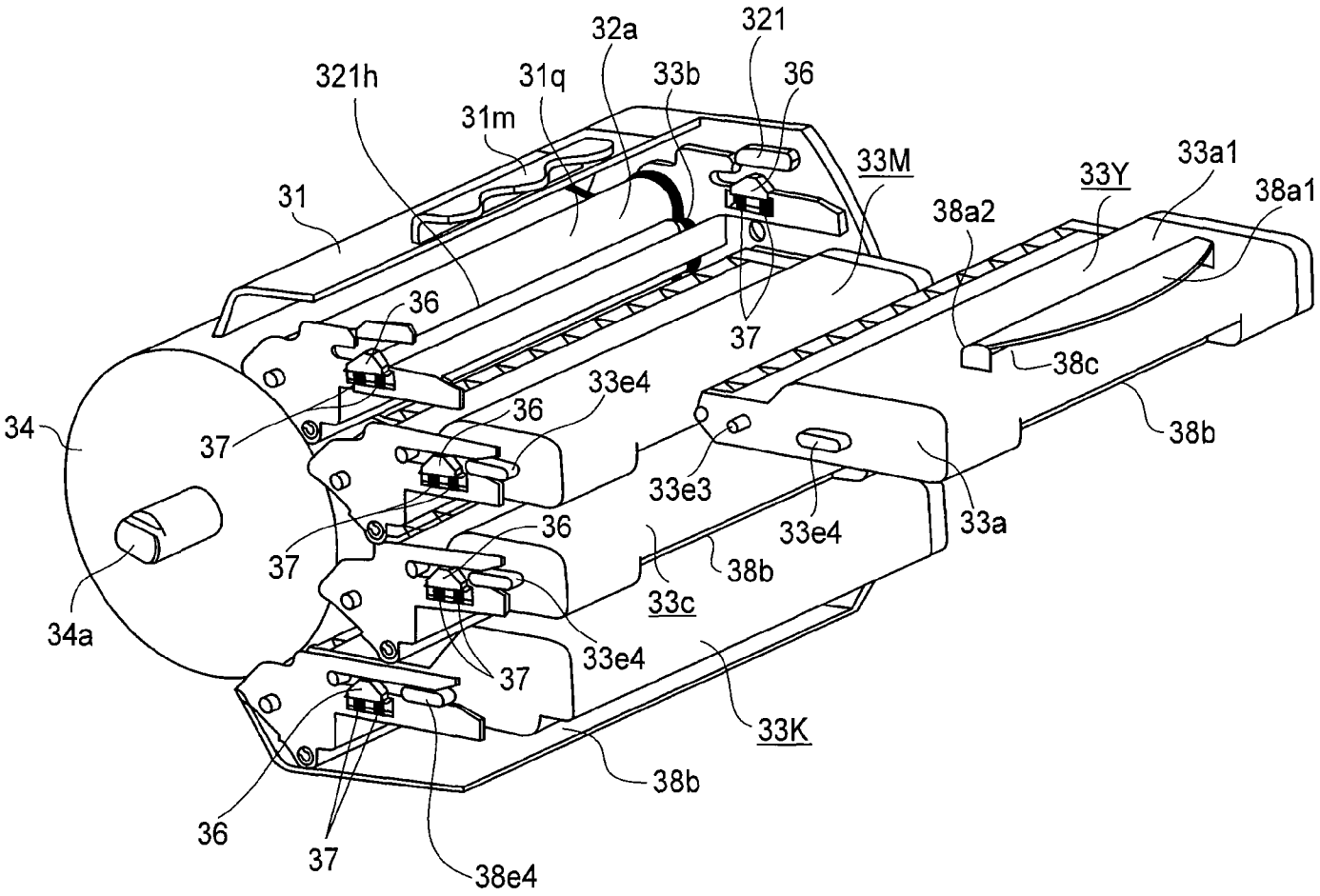
FIG. 20 is a perspective view of the unit and the cartridge.

The user moves the unit 200 in the arrow X8, while griping the first grip 38 or grip (second grip) 31*m*. At this time, the user may grip the grip (first grip) 38 or grip (second grip) 31*m*. In this embodiment, the grip 38 provided in the cartridge 33Y is in the outside of the unit 200, and therefore, it is easy to grip it and easy to recognize it. In other words, the first grip 38 is placed more outward, with respect to a turning radius direction of the unit 200, than the grip 31*m*. More particularly, in the mounting direction of the cartridge 33, the grip 38 is placed in the upstream side of the grip 31*m*. Therefore, the grip 38 is placed in the position nearer to a position of the operation of the mounting and demounting of the cartridge 33 by the user, than the grip 31*m*. In the case where the cartridge 33 (cartridge 33Y) is not mounted to the unit 200, while griping the grip 31*m*, the user can rotate the unit 200 (FIG. 20). In the case where the cartridge 33Y is mounted to the unit 200, while the user grips the grip 38 or the grip 31*m* whichever is easy to operate, the user rotates the unit 200. In the case where the cartridge 33Y is mounted to the unit 200, a trailing end of the cartridge 33Y may project from a trailing end of the unit 200, and in this case, it is easier to operate the grip 38 than the grip 31*m*. The grip 38 is provided with a gap 38*c* into which the user can insert the hand. The gap 38*c* is outwardly opened in the radial direction of the unit 200, and therefore, it is easy to operate, when the user moves the unit 200. The first grip 38 is provided on the cartridge 33Y in the downstream-most position with respect to the rotational direction (the direction of the arrow X9) toward the mounting and dismounting position B, among the cartridges 33 (33Y, 33M, 33C and 33K). In the case where the cartridge 33Y is not mounted, the user grips the grip 31*m*.

When the user rotates the unit 200 while gripping the grip 38, the portions-to-be-guided (portions-to-be-regulated) 33*e*1 and 33*e*3 are prevented from the movement by the regulating member 36 placed in the regulation position D. Therefore, even if the force is somewhat applied to the cartridge 33Y in the direction of separating out of the unit 200 in moving the unit 200 while griping the grip 38, the cartridge 33 is limited by the regulating member 36. Therefore, the deviation of the cartridge 33 outward of the unit 200 can be suppressed. In other words, the regulating member 36 limits the disengagement of the cartridge 33Y, when the unit 200 is rotated to a before-mounting-demounting-position C from the mounting and dismounting position B, when the unit 200 rotates to the image forming position A, and when the unit 200 rotates in the opposite direction. At this time, the regulating member 36 is placed in the regulation position D. The urging force (elastic force) of the urging member (resilient member) 37 which urges the regulating member 36 is set the, such that the movement, in the direction opposite from the mounting direction, of the portions-to-be-guided 33*e*1 and 33*e*3 is limited, when the user rotates the unit 200 while griping the grip 38. The urging force is set such that in the mounting and dismounting position B, the portions-to-be-guided 33*e*1 and 33*e*3 move the regulating member 36 to the permission position E in accordance with the user's mounting and demounting operation, thereby to ride over the regulating member 36. Also in the other cartridges 33M, 33C and 33K, the portions-to-be-guided 33*e*1 and 33*e*3 are regulated by the regulating member 36. Therefore, the cartridge 33 does not disengage from the unit 200. The portions-to-be-guided 33*e*1 and 33*e*3 are regulated by the mounting portion 321 in the up-down direction. Therefore, even if the user moves the unit 200 in the direction of the arrows X8, X9 while gripping the second grip 38, the cartridge 33Y does not separate.

Figure 15A:
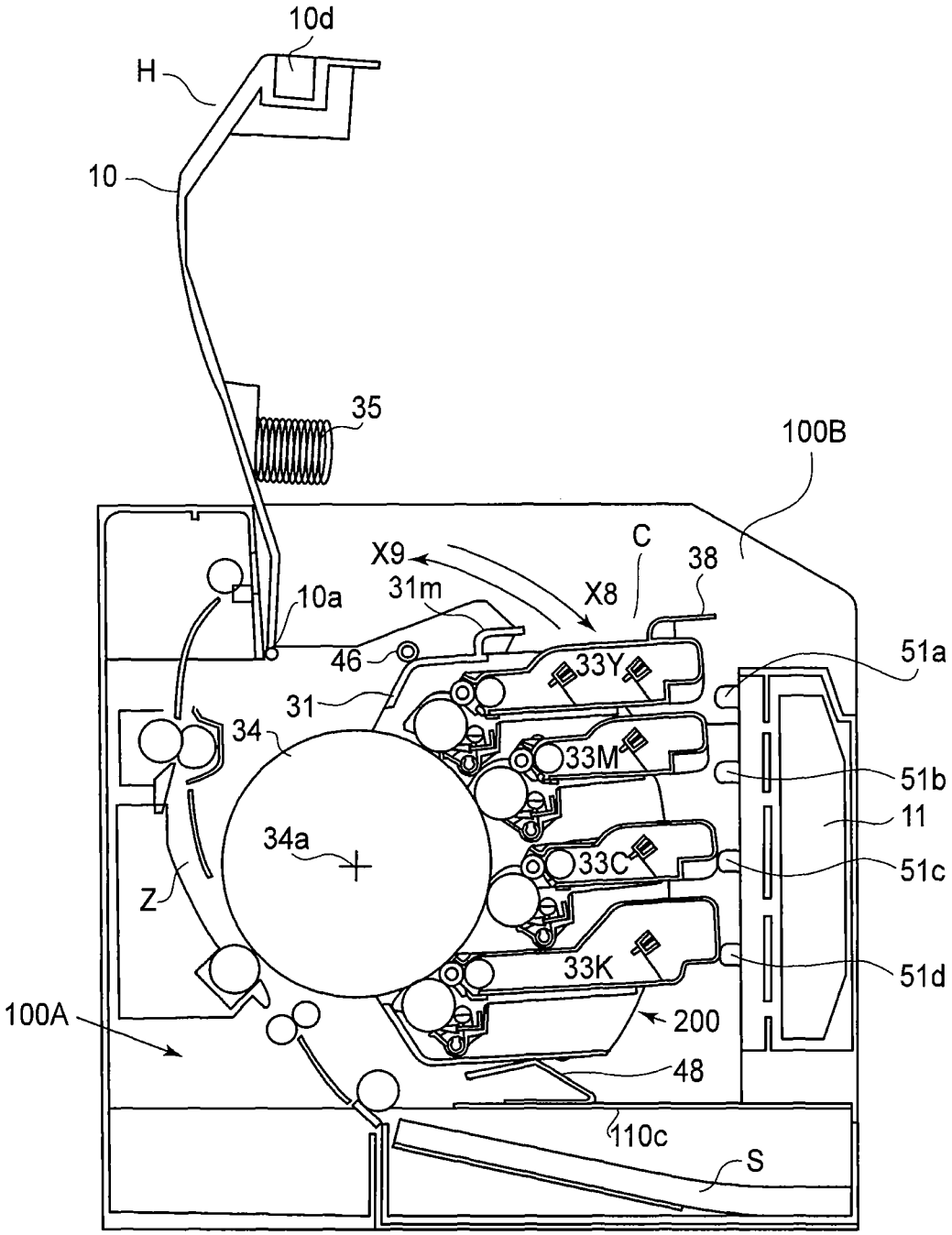
FIGS. 15A and 15B are illustrations of the mounting and demounting of the cartridge relative to the unit.
Figure 15B:
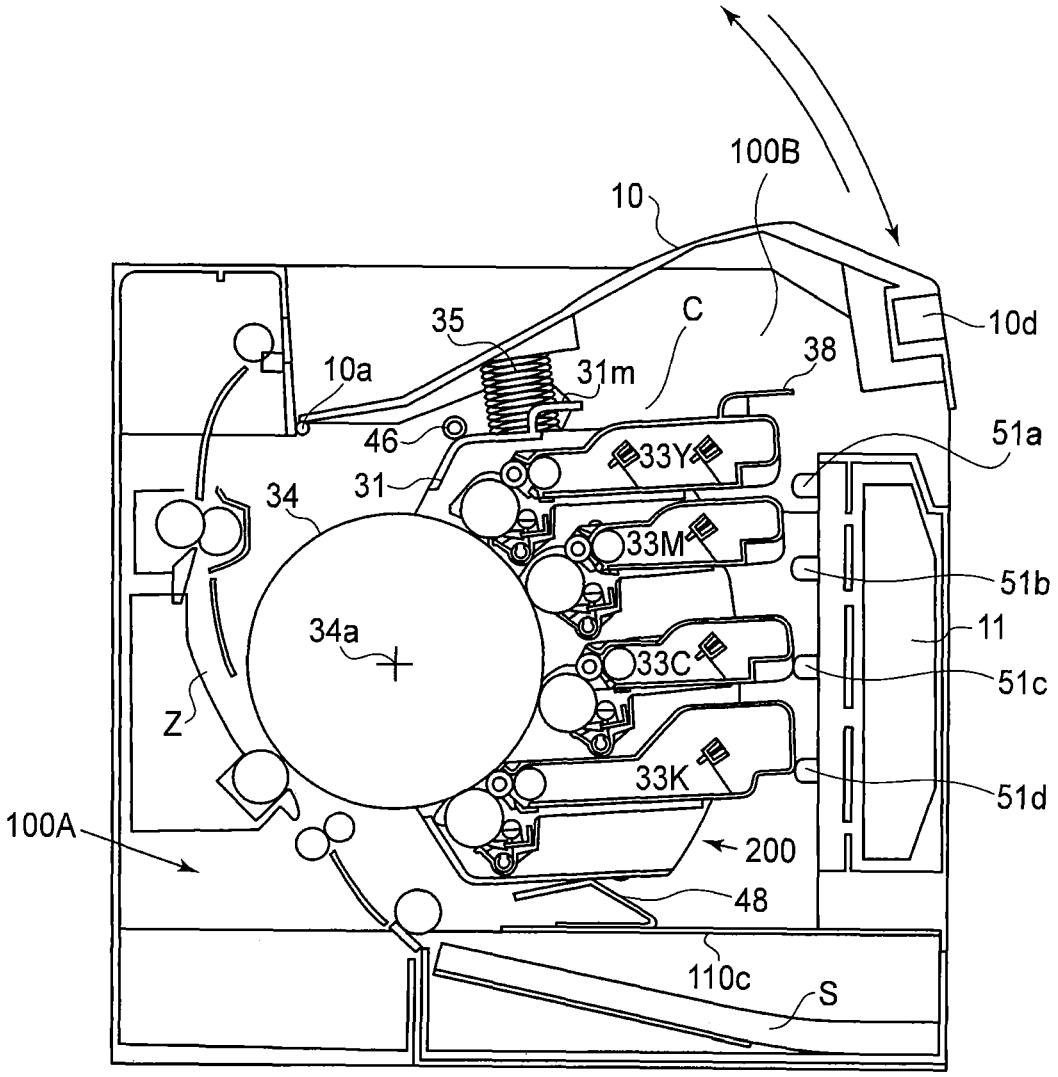
Figure 16A:
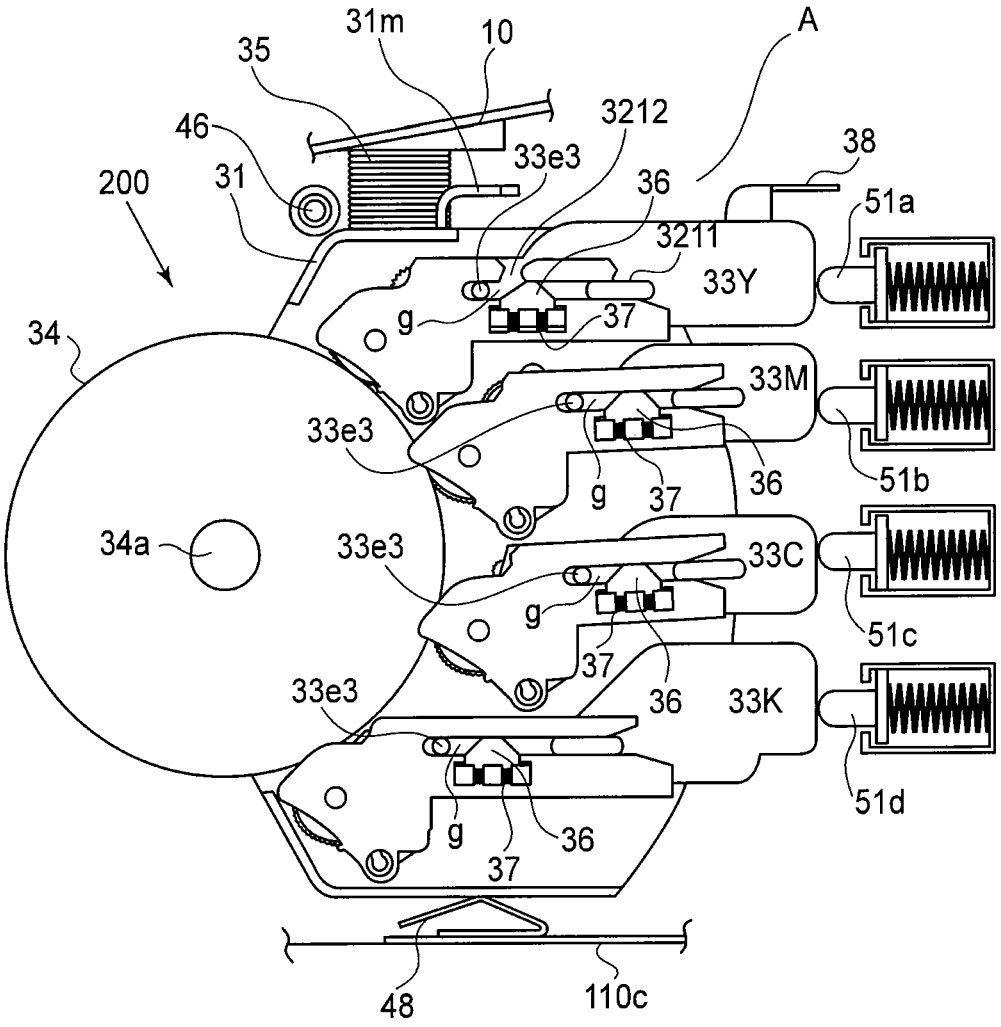
FIGS. 16A and 16B are illustrations of the mounting and demounting of the cartridge relative to the unit.
Figure 16B:
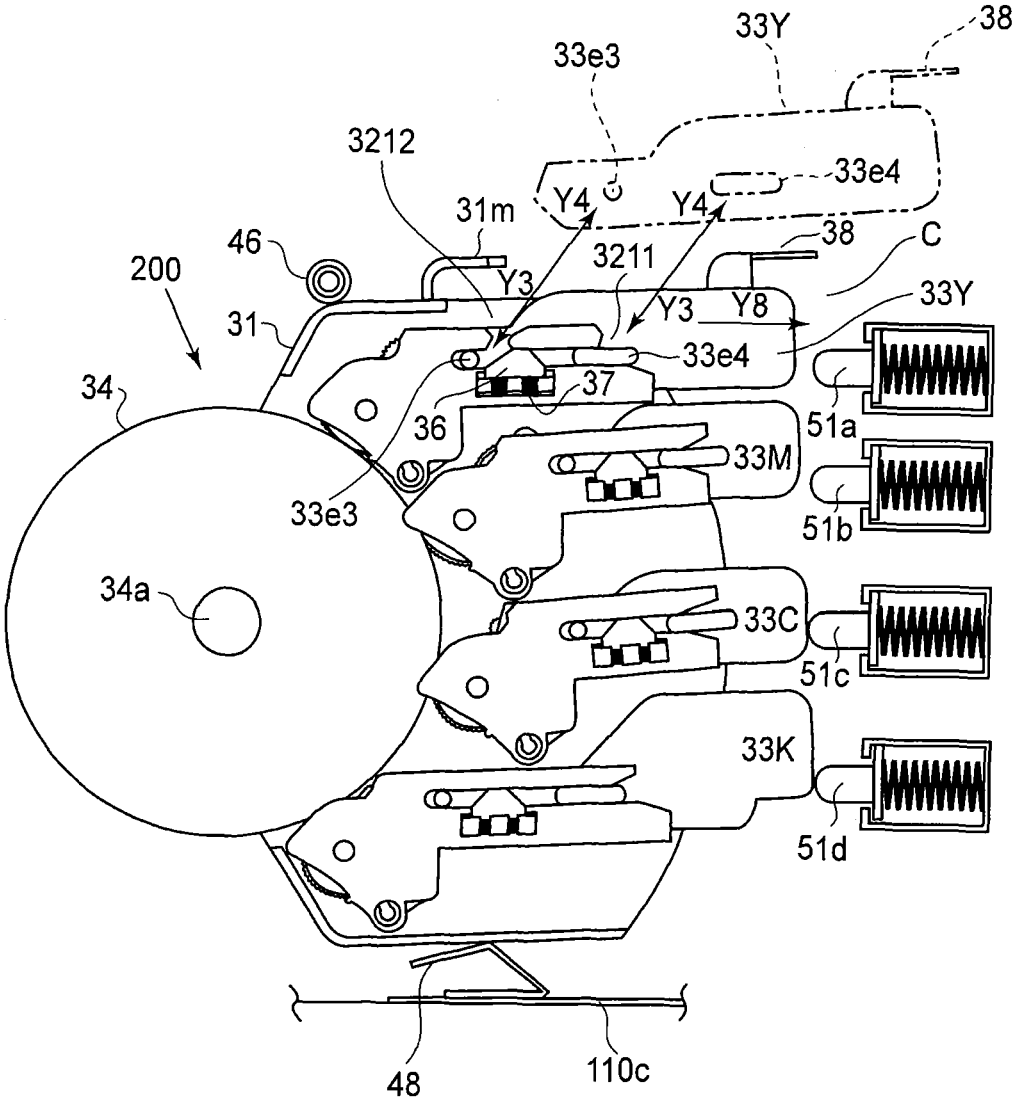
Figure 17:
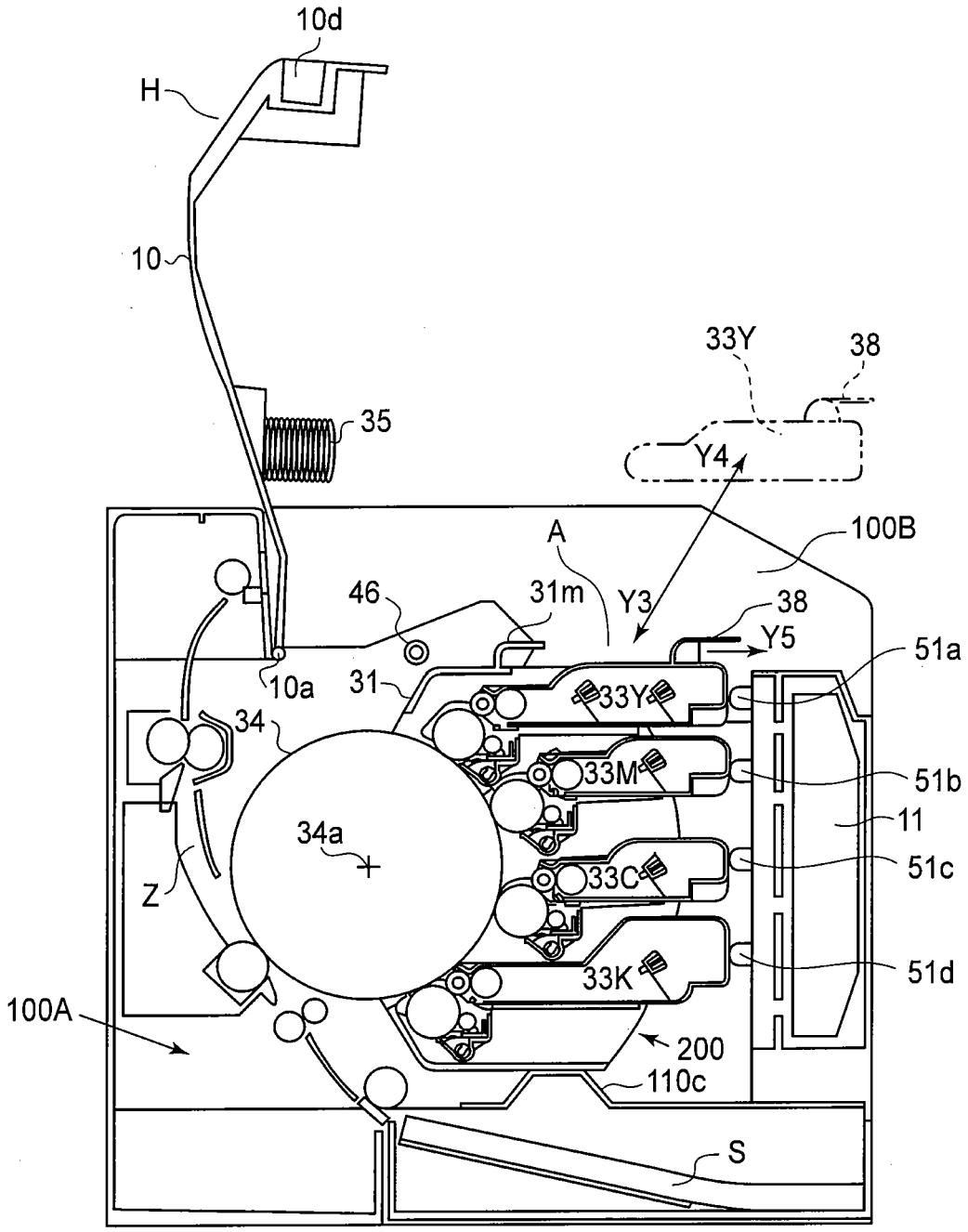
FIG. 17 is an illustration of the mounting and demounting of the cartridge relative to the unit.

In the main assembly 100A, the top surface of a lower side stay 110*c* of the main frame 110 is provided with the spring (urging member) 48. The user rotates the unit 200 toward the image forming position A from the mounting and dismounting position B of FIG. 14B. Then, as shown in FIG. 15A, the lower surface of the frame 31 of the unit 200 abuts to the spring 48 in a position C frontward beyond the image forming position A. FIG. 16B is an enlarged view of the unit 200 of FIG. 15A. Therefore, even if the user rotates the unit 200 downwardly with a quite strong force, such a force can be accommodated by the elastic force of the spring (resilient member) 48. The elastic force of the spring 48 is sufficiently larger than the force by the weight of the unit 200, and therefore, the unit 200 is rested in the state of receiving the elastic force from the spring 48. At this time, a portion-to-be-regulated-in-rotation 311 (FIG. 6B) of the unit 200 is not abutted to the rotation regulating portion 80*c* (FIG. 7(*a*) provided on the guiding plate 80R. The unit 200 is in front of the image forming position A. This position is a before-mounting-demounting-position C. The provision of the spring 48 can prevent the damage of the members in the unit 200, the cartridge 33, the photosensitive member unit 32, and the main assembly 100A attributable to the impact and so on, when the user rotates the unit 200. The spring 48 may be provided in the unit 200, and what is necessary is just to provide it between the unit 200 and the main assembly 100A. In other words, in moving the unit 200 from the mounting and dismounting position B to the image forming position A, it may be interposed between the unit 200 and the main assembly 100A. In this embodiment, as the spring 48, a leaf spring is used, but it may be a coil spring or the like. Depending on the weights such as the unit 200 and the cartridge 33 inserted into it, the spring 48 may be omitted. FIG. 17 is a view in the case of the spring 48 being omitted. In this case, the lower surface of the sub-frame 31 is directly received by the top surface of the lower side stay 110*c* of the main frame 110 not through the before-mounting-demounting-position C. The unit 200 is placed in the image forming position A. As shown in FIG. 15A, in the state that the unit 200 is placed in the before-mounting-demounting-position C, the user stops the gripping of the second grip 38 or the grip 31*m*, and moves the cover 10 from the open position H to the closing position G (FIG. 15B). When the cover 10 is rotated to the position before the closing position G, the urging spring (urging member) 35 provided in an inner surface of the cover 10 contacts to the portion-to-be-urged 31*p* (FIG. 6A, 6B) provided on the top plate 31C of the frame 31 of the unit 200 placed in the before-mounting-demounting-position C. Also thereafter, the cover 10 is rotated in the closing direction against the urging forces (elastic forces) of the spring 35 and the spring 48. The urging force of the spring 35 is larger than the urging force (elastic force) of the spring 48. Therefore, the unit 200 is contacted to the positioning portion 80*a* in the shaft portions 45L, 45R thereof against the urging force of the spring 48. Furthermore, the portion-to-be-regulated-in-rotation 311 is contacted to the rotation regulating portion 80*c* provided on the guiding plate 80R. By this, the unit 200 is positioned in the image forming position A relative to the main assembly 100A. As shown in FIG. 9(*b*), the locking claw portion 10*b* provided in the cover (10) side corresponds to a locking claw portion 136*a* provided in the maintenance button (136) side. By the further rotation of the cover 10 in the closing direction, the cover 10 sufficiently moves to the closing position G. Then, the cover (10) side locking claw portion 10*b* engages with the locking claw portion 136*a* in the side of the button (136) (latch engagement) (FIG. 9(*a*)). By this, the cover 10 is locked with the closing position G. The cover 10 is urged in the open direction by a compressive reaction forces (elastic forces) of the spring 35 and the spring 48. However, as has been described in the foregoing, the cover 10 is fixed to the main assembly 100A by the locking of the locking claw portions 10*b*, 136*a*. For this reason, the unit 200 is pressed to and rested in the main assembly 100A by the spring 35 in the state of being positioned in the image forming position A (FIG. 1B, FIG. 16A). More particularly, the unit 200 is locked with the image forming position A by the cooperation of the cover 10, the cover side locking claw portion 10*b*, the button (136) side locking claw portion 10*b*, the spring 35, the portion-to-be-regulated-in-rotation 311, and the rotation regulating portion 80*c*. In this embodiment, the spring 35 is mounted to the cover 10. However, the spring may be provided in the unit 200, wherein a part of cover 10 is contacted to the urging spring. In other words, the structure may be such that it is interposed and contacted between the unit 200 and the cover 10 in interrelation with the closing operation of the cover 10.

The main assembly 100A is provided with a cartridge urging member (resilient member) 51 (51*a*-51*d*) for elastically urging each cartridge 33 toward the associated photosensitive member unit 32 in the state that the unit 200 is placed in the image forming position A. The urging member 51 is provided at each of the one-end portion and the other end portion with respect to the longitudinal direction (left-right direction) of the cartridge 33. More particularly, the two urging members 51 are provided in each of the cartridge 33. The urging members 51 are sequentially contacted the rear end portions of the cartridges 33 in accordance with the rotational operation of the unit 200 toward the image forming position A. The urging members 51 sequentially contact to the cartridge 33, and therefore, the mounting property can be improved. In other words, as compared with the type in which all the urging members 51 are contacted at once, the load applied by the urging members 51 can be dispersed. Therefore, the load at the time of the operation for rotating the unit 200 can be reduced. As shown in FIG. 1B, when the unit 200 is placed in the image forming position A, the cartridge 33 is elastically urged in the direction of the arrow Y2 by the urging member 51. The developing roller 33*b* in the cartridge 33 is contacted by the constant urging force to the drum 32*a* by contacting the regulation rollers 60 (FIG. 5) provided at the opposite ends thereof to the drum 32*a*. By the provision of the roller 60, the developing roller 33*b* is urged to the drum 32*a* with space therebetween. When the roller 60 is not used, the developing roller 33*b* is urged to the drum 32*a* in the state that the developing roller 33*b* and the drum 32*a* contact to each other over the length. The urging force (elastic force) by the urging member 51 can satisfactorily maintain the contact state (or spacing state) between the developing roller 33*b* and a drum 32*a*. The urging member (resilient member) 51 is a leaf spring, a coil spring, a rubber member, for example.

When the unit 200 loaded with the cartridge 33 is placed in the image forming position A, the portions-to-be-guided 33*e*1 and 33*e*3 provided in the cartridge 33 are in the position free from the urging force by the regulating member 36, as shown in FIG. 16A. In other words, the portions-to-be-guided 33*e*1 and 33*e*3 are in the position of not contacting to the regulating member 36. At this time, gap g is provided between the portions-to-be-guided 33$e$1 and 33$e$3 and the regulating member 36. Therefore, the urging force of the urging member 37 which urges the regulating member 36 is not influential to the urging force of the cartridge 33 relative to the unit 32. Therefore, the urging force of the cartridge 33 can be maintained with high precision. It is satisfactory that the gap g is such that, when the cartridge 33 moves from the mounting and dismounting position B to the image forming position A, (or the opposite direction), it does not contact to the member of the main assembly 100A and so on (except for the cartridge urging members 51$a$-51$d$). By doing so, the accuracy of the urging force of the cartridge 33 relative to the drum 32$a$ is enhanced, and the operation of the stabilized unit 200 is accomplished.

By the above-described operation, the device 100 becomes in the state that an image forming operation (print operation) can be carried out, and the image forming operation described above is carried out on the basis of an image formation start signal (print start signal). The drive outputting portion (unshown) of the main assembly (100A) side is coupled with the gear 34$b$ which is the drive inputting portion of the intermediary transfer member 34 of the unit 200 placed in the image forming position A. The drum gear 32$a$1 of each photosensitive member unit 32 couples with the gear 34$b$. The gear 50 of the developing roller 33$b$ of each cartridge 33 is coupled therewith. The electric power supply system of the main assembly side is electrically connected to the electrical contacts of the photosensitive member units 32 and the cartridges 33. By this, the image forming apparatus 100 is capable of carrying out the image forming operation.

In this embodiment, the scanner unit 11, the cartridge 33, the drum 32$a$, the transfer member 34, and the feeding path Z for the recording material S are disposed substantially in parallel with the installation surface F, as shown in FIG. 1B. In the upper portion of the apparatus 100, the cover 10 functioning also as the discharging tray is provided, and the cassette 19 is provided in the lower portion of the device 100. The laser beams L (LY, LM, LC and LK) are projected from the scanner unit 11 to the drum 32$a$ in the rear part of the cartridge 33. The color developer image transferred onto the transfer member 34 from each drum 32$a$ is transferred onto recording material S in the opposite side from each drum 32$a$ with respect to the transfer member 34. Furthermore, according to this embodiment, the unit 200 can be rotated between the image forming position A and the mounting and dismounting position B in the state that the drum 32$a$ is mounted to the unit 200, and the cartridge 33 is dismountably mounted to the unit 200 (mounting portion 31$c$). By rotating the unit 200 from the image forming position A to the mounting and dismounting position B, the cartridge 33 is mounted and demounted relative to the unit 200. By such a structure, the device 100 can be downsized. The user can manually rotate the unit 200 about the rotation axis (rotation axis) 34$a$. The rotation axis 34$a$ is co-axial with the axis of the transfer member 34.

(Exchange of Cartridge and Residual Developer Container)

In each of the cartridges 33 (33Y, 33M, 33C and 33K), the developer contained in the developer accommodating portion 33$c$ of the cartridge 33 is consumed as it is used for the image formation. In view of this, means (unshown) for detecting a developer remainder of each cartridge 33, for example, is provided, and the control circuit portion 300 compares a detected remaining amount value with the threshold for a cartridge lifetime notice or a lifetime warning set beforehand. As for the cartridge 33 exhibiting less detected remaining amount value than the threshold, the lifetime notice or the lifetime warning of such a cartridge 33 is displayed on the display portion 102 (FIG. 1A) provided in an operating portion 101 of the image forming apparatus 100. Or, the lifetime notice or the lifetime warning about the cartridge 33 thereof is displayed on the display portion (unshown) of the external host device 400. By this, a preparation of the cartridge for the exchange is prompted, or the exchange of the cartridge is prompted for the user. Also with respect to the residual developer container (removed developer accommodating portion) 40, it is detected that the amount of the residual developer (removed developer) in the container 40 exceeds the predetermined level. The warning is displayed on the display portion 102 and so on the basis of the result of detection to prompt the exchange of the container 40.

In this embodiment, in the case of the exchange of each cartridge 33 mounted to the unit 200 and the exchange of the container 40, the user opens the cover 10 to open the opening portion 100B. As shown in FIG. 1B, for the closure releasing of the cover 10 locked at the closing position G, the user pushes a maintenance button 36 on the front side of the main assembly 100A, as shown by the chain lines in FIG. 9($a$). When the user pushes the button 36 rearwardly against the spring (unshown), the button (36) side locking claw portion (first locking portion) 36$a$ escapes from the cover (10) side locking claw portion (second locking portion) 10$b$ rearwardly to release the latch engagement, as indicated by the chain lines. In this manner, the cover 10 is pushed up by the compressive reaction forces (elastic forces) of the spring 35 and the spring 48. The cover 10 is rotated in an open direction from the main assembly 100A by an angle corresponding to an operation distance (restoration length to a free length) of the spring 35 and spring 48 about the hinge shaft 10$a$. More particularly, the cover 10 becomes in the partly open state automatically by the elastic forces of the spring 35 and the spring 48. FIG. 9($b$) and FIG. 15B show the partly open state of the cover 10. Thereafter, when the user lifts the finger from the button 36, the force (elastic force) of the urging spring (unshown) restores it to the previous position. At this time, the locking claw portion 10$b$ is placed at the upper portion by the partly opening movement of the cover (opening and closing member) 10, and therefore, it does not engage with the locking claw portion 36$a$ when returned (FIG. 9($b$)). The user hangs fingers on a grip portion 10$d$ of the cover 10 in the partly open state, and opens the cover 10 by a manual operation to the open position H, as shown in FIG. 15A. The cover 10 is sufficiently opened to the open position H so that it is received by a stopper portion of the main assembly side, and thereafter, even if the user moves the hand off, the state is maintained stably. Or, it is locked by a click stop mechanism and a catching mechanism to stably maintain the opening state even if the user moves the hand off since then. By this, the opening portion 100B is sufficiently opened greatly. The unit 200 is released from the urging force (a pressing and elastic force) by the spring 35 by the releasing of a locking of the cover 10 relative to the closing position G. By this, the unit 200 is moved from the image forming position A to the before-mounting-demounting-position C by the urging force of the spring 48. The unit 200 moved to the before-mounting-demounting-position C is exposed through the opened opening portion 100A. The user can see the unit 200 moved to the before-mounting-demounting-position C, and the subsequent the direction of the operation of the unit 200 is suggested. In other words, it is observed that the cartridge 33 mounted to the unit 200 moves toward a mounting and dismounting position (direction of arrow X9). In this manner, the user can understand the movement of the unit 200 in the direction of the arrow X9 which is the next operation intuitively. Therefore, it can assist the user's operation for the unit 200. The second grip 38 of the cartridge 33Y and the grip 31$m$ of the sub-frame 31 projects in the rotational direction (toward the opening portion 100B) of the unit 200. Therefore, the user can easily recognize the positions of the second grip 38 and the grip 31*m*. Therefore, the subsequent operation is easy. While the user grips the first grip 38 or the grip 31*m*, the user rotates or moves the unit 200 in the direction of the arrow X9 to place the unit 200 in the mounting and dismounting position B (FIG. 14B). In the case where the spring 48 is not used (FIG. 17), the user moves the unit 200 placed in the image forming position A to the mounting and dismounting position B, while gripping the second grip 38 or the grip 31*m*. The portion-to-be-regulated 31*n* of the unit 200 placed in the mounting and dismounting position B is engaged with the main assembly 100A side regulating portion 46, as described above. In this manner, the unit 200 is temporarily fixed (lightly locked) in the mounting and dismounting position B so that the movement toward the image forming position A is limited. More particularly, the unit 200 is not rotated downwardly even if the user moves his/her hand off. In this state, the cartridge 33 and the container 40 or the cartridge 33 or the container 40 is dismounted in the opposite direction. In other words, when the unit 200 is placed in the mounting and dismounting position B, the cartridge 33 and the container 40 is detachably mountable relative to the unit 200. In the temporary fixing of the unit 200 in the mounting and dismounting position B, although the downward rotation of the unit 200 is regulated, the unit 200 can move toward the image forming position A by the user applying the force downwardly.

Here, as for the cartridge 33Y placed in the most downstream side with respect to the rotational direction X9 from the image forming position A to the mounting and dismounting position B, the mounting and dismounting operation is capable also in the before-mounting-demounting-position C. Referring to FIG. 16B and FIG. 19, the description will be made as to this operation. As described above, the mounting portion 321*h* of the cartridge 33Y is divided into the first mounting portion (first path) 3211 and second mounting portion (second path) 3212. The first mounting portion 3211 is used in the mounting and dismounting position B, and therefore, the cartridge 33Y is detachably mountable relative to the unit 200 (FIG. 14A and FIG. 18). In the before-mounting-demounting-position C (or mounting and dismounting position B), the first mounting portion 3211 or the second mounting portion 3212 is used, and therefore, the cartridge 33Y is detachably mountable relative to the unit 200. As indicated by a chain line in FIG. 14A, the cartridge 33Y is detachably mountable relative to the unit 200 in the direction of the arrow Y3, and the direction of the arrow Y4. As shown in FIG. 17, when the spring 48 is omitted, the mounting and demounting of the cartridge 33Y is possible in the image forming position A. First mounting portion (first path) 3211 is provided with a path 321*c*. The path 321*c* is substantially horizontally extended relative to the installation surface F, and is extended over the range from the upstream side to the downstream side of the regulating member 36 in the mounting direction Y6 of the cartridge 33Y. The second mounting portion (second path) 3212 is provided with a path 321*d* and a path 321*e*. The paths 321*d* and 321*e* are extended in the direction perpendicular to the path 321*c*. The path 321*d* is across the path 321*c* at the downstream side of the regulating member 36 with respect to the mounting direction Y6. The path 321*e* is across the path 321*c* at the upstream side of the regulating member 36 with respect to the mounting direction Y6. More specifically, in the mounting of the cartridge 33Y, the portions-to-be-guided 33*e*1 and 33*e*3 of the cartridge 33Y are placed correspondingly to the second mounting portion 3212 (path 321*d*) in the upper portion of the first and second mounting portions 3211 and 3212. The portions-to-be-guided 33*e*2 and 33*e*4 are placed correspondingly to the first mounting portion 3211 (path 321*e*) (FIG. 19(*a*)). The cartridge 33Y is moved in the direction of the arrow Y3. By this, the portions-to-be-guided 33*e*1 and 33*e*3 enter the recess 321*a* of the second mounting portion 3212 (recess rearward beyond position of regulating member 36 (main assembly side positioning portion) 321*a*). More particularly, the portions-to-be-guided 33*e*1 and 33*e*3 reach the recess 321*a* through the path 321*d*. The portions-to-be-guided 33*e*2 and 33*e*4 reach the path 321*c* through the path 321*e* to enter the path 321*c* in the mounting direction (FIG. 19(*b*)). Furthermore, the cartridge 33Y is moved downstream with respect to the mounting direction of the arrow Y6. By this, the cartridge 33Y is mounted to the unit 200 (FIG. 19(*c*)). The portions-to-be-guided 33*e*1 and 33*e*3 is disposed at the one-end portion and the other end portion of the developing roller 33*b* co-axially with the developing roller 33*b*. Therefore, the cartridge 33Y is positioned relative to the unit 200 with respect to the developing roller 33*b*. Also as to the other cartridges, the same applies. When dismounting the cartridge 33Y from the unit 200 on the contrary, in the before-mounting-demounting-position B (or image forming position A), the user moves the cartridge 33Y to the method improvement style side of the mounting of the arrow Y5 while gripping the first grip 38. Thereafter, the cartridge 33Y is raised in the direction of the arrow Y4. In this manner, the portions-to-be-guided 33*e*1 and 33*e*3 pass the path 321*d* to separate from the second mounting portion 3212, and the portions-to-be-guided 33*e*2 and 33*e*4 pass the path 321*e* to separate from the first mounting portion 3211. By this, the cartridge 33Y is dismounted upwardly from the unit 200. It crosses in the course of the paths of the first mounting portion 3211 (path 321*c*) and the second mounting portion 3212 (paths 321*d* and 321*e*), and therefore, cartridge 33Y can mount and demount in two different directions. The frame 31 is provided with a notch 31*q* (FIG. 6A and 6B, FIG. 20) above the cartridge 33Y. Therefore, the cartridge 33Y can be dismounted upwardly using the second mounting portion 3212 (paths 321*d* and 321*e*). The cartridge 33Y can be mounted downwardly using the second mounting portion 3212. The notch 31*q* has the concave shape constituted by side plates 31L, 31R and the top plate 31C. By the structure as described above, the cartridge 33Y can be mounted and demounted without the operation of moving the unit 200 to the mounting and dismounting position B. Therefore, an advantage for the user is large. As described above, the unit 200 is provided with the first path 321*c* to dismount and mount the cartridge 33Y relative to the topmost mounting portion 321*h* (FIG. 2) among the mounting portions 321 (FIG. 19). The unit 200 is provided with the second paths 321*d* and 321*e* to dismount and mount the cartridge 33Y relative to the mounting portion 321*h* through the path different from the first path 321*c* (FIG. 19). In this manner, the cartridge 33Y is detachably mountable in the mounting and dismounting position B and Image forming position (transfer position) A relative to the mounting portion 321*h*. More particularly, in the mounting and dismounting position B, the cartridge 33Y is detachably mountable relative to the mounting portion 321*h* also through either of the first path 321*c* or the second path 321*d*, 321*e*. In the image forming position A, the cartridge 33Y is detachably mountable relative to the mounting portion 321*h* only by the second paths 321*d* and 321*e*. The spring (urging member) 48 is provided between the unit 200 and the main assembly 100A. In view of this, the unit 200 is moved upwardly by the elastic force of the spring 48. The unit 200 can take the before-mounting-demounting-position C which is between the image forming position A and the mounting and dismounting position B. The cartridge 33Y is detachably mountable to the top mounting portion 321*h* in the mounting and dismounting position B and the before-mounting-demounting-position C. In the mounting and dismounting position B, the cartridge 33Y is detachably mountable relative to the mounting portion 321*h* also through either of the first path 321*c* or the second path 321*d*, 321*e*. In the before-mounting-demounting-position C, the cartridge 33Y is detachably mountable relative to the mounting portion 321*h* only by the second paths 321*d* and 321*e*. Using the first path 321*c*, the cartridge 33Y is moved in the direction perpendicular to the longitudinal direction (longitudinal direction of developing roller 33*b*) of the cartridge 33Y, and is mounted and demounted relative to the mounting portion 321*h*. Using the second paths 321*d* and 321*e*, the cartridge 33Y is moved in the direction crossing with the direction, and is mounted and demounted relative to the mounting portion 321*h*. The cartridge 33Y is provided with the portions-to-be-guided 33*e*1-33*e*4 at the one and the other longitudinal ends of the developing roller 33*b*. The unit 200 has the portions-to-be-guided 33*e*1-33*e*4 as the first path 321*c* to mount and demount the cartridge relative to the mounting portion 321*h*. The unit 200 is provided with the second paths 321*d* and 321*e* to enter and retract the cartridge 33Y perpendicularly relative to mounting portion (main assembly side guide portion) 3211. The unit 200 is provided with the path for guiding the portions-to-be-guided 33*e*1-33*e*4 horizontally as the first path 321*c* to mount and demount the cartridge 33Y relative to the mounting portion 321*h*. The unit 200 is provided with the path for entering and retracting perpendicularly the portion-to-be-guided 33*e*1-33*e*4 relative to the first path 321*c* as the second paths 321*d* and 321*e*.

In the embodiment described above, the first path and the second path are provided, but the paths can be modified properly. If the mounting and demounting is carried out in the mounting and dismounting position B, for example, only the first path may be provided.

With the structure of the above-described image forming apparatus, the exchange of the cartridge 33 is possible without retracting a scanner unit (image exposure device) 11. By this, the user can exchange the developing cartridge 33 easily. The transfer member 34 is in the form of a drum, and the unit 200 is rotatable about the center axis of the transfer member 34. By this, it is not necessary to greatly retract the member in the main assembly 100A in the movement of the unit 200 between the image forming position A and the mounting and dismounting position B. The internal cartridge 33 can be exchanged without drawing the unit 200 to an outside of the main assembly 1010A. For this reason, the device 100 can be downsized. In this embodiment, the transfer member is the intermediary transfer member 34 for transferring the image indirectly onto the recording material S from the drum 32*a*. However, this is not inevitable, and it may be of the type of transferring the image directly onto the recording material S from the drum 32*a*. At this time, the transfer member 34 transfers the developed image directly from the drum 32*a* onto the recording material S. In this embodiment, the cartridge which is to be exchanged is the developing cartridge 33 used for the process cartridge of the discrete type. However, this is not restrictive, and the cartridge which is to be exchanged may be the process cartridge which integrates a photosensitive unit 32 and developing cartridge 33.

According to the embodiment described above, the mounting and dismounting operativity at the time of mounting and demounting the cartridge 33 relative to the main assembly 100A can be improved.

According to the embodiment described above, the manual rotation property of the image forming unit 200 movable between the mounting and dismounting position B for carrying out the mounting and demounting of the cartridge 33 and the transfer position A for transferring the developer image onto the recording material S from the transfer member 34 can be improved.

According to the embodiment described above, the mounting and dismounting operativity at the time of mounting and demounting the cartridge 33 relative to the image forming unit 200 movable between the mounting and dismounting position B in which the cartridge 33 is mounted and demounted and the transfer position A for transferring the developer image onto the recording material S from the transfer member 34, can be improved.

According to the embodiment described above, at the time of the exchange of the cartridge 33, an exchanging operation of the cartridge 33 is capable without retracting the laser scanner unit (image exposure device) 11.

According to the embodiment described above, when the unit moves between the transfer position A and the mounting and demounting position B, the cartridge 33 mounted to the mount portion 321 is substantially prevented from moving outwardly of the unit 200.

According to the embodiment described above, the movement of the cartridge 33 can be regulated or substantially prevented.

More particularly, in the state that the cartridge 33 is mounted, the movement of the cartridge 33 relative to the unit 200 which is movable between the mounting and demounting position B for mounting and demounting the process cartridge 33 and the transfer position B for transferring the developer image from the transfer member 34 to the recording sheet S.

In the foregoing embodiment, the unit 200 has been described as being rotatable, but the present invention is not limited to this example.

For example, the unit 200 may be movable in parallel with the installation surface of the apparatus 100 (so-called drawer type). Therefore, the movement is not limited to rotation.

The present invention is not limited to the case where a plurality of cartridges are supported, but covers the case where a single cartridge is supported.

For this reason, the present invention is applicable to a monochromatic electrophotographic image forming apparatus.

According to the embodiment described above, the regulating member 36 is positioned in the regulating a position D when the unit is placed in the transfer position A and in the mounting and mounting position.

This is effective to stabilize the cartridge mounting.

However, the present invention is not limited to the structure.

The regulating member 36 is placed in the permission position E when the unit 200 is placed in the transfer position A and the mounting and dismounting position B.

Therefore, in the present invention, when the unit 200 moves between the transfer position A and the mounting and the mounting position B, it is satisfactory that the regulating member 36 is at least in the regulating position D.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 069959/2009 and 032415/2010 filed Mar. 23, 2009 and Feb. 17, 2010, respectively, which are hereby incorporated by reference.

What is claimed is:

1. An electrophotographic image forming apparatus for forming an image on a recording material comprising:

an image forming unit including a mounting portion for demountably mounting a cartridge, said image forming unit being movable, relative to a main assembly of said electrophotographic image forming apparatus in a state that said cartridge is demountably mounted to said mounting portion, between an image forming position for executing image formation, and a mounting and demounting position, different from the image forming position, for mounting and demounting said cartridge;

a preventing member provided on said image forming unit and movable between a preventing position for preventing said cartridge mounted to said mounting portion from moving outwardly of said mounting portion, and a permitting position for permitting said cartridge to be mounted to said mounting portion;

a portion-to-be-prevented, provided on said cartridge, to be prevented by said preventing member; and a contact portion, provided in said main assembly, for contacting said cartridge to press said cartridge toward said mounting portion by movement of said image forming unit from the mounting and demounting position toward the image forming position.

2. An apparatus according to claim 1, wherein said portion-to-be-prevented includes a portion-to-be-guided to be guided by a main assembly side guide provided in said main assembly when said cartridge is inserted into said mounting portion.

3. An apparatus according to claim 1, wherein said preventing member is moved from the preventing position to the permitting position by said portion-to-be-prevented in response to a dismounting operation of said cartridge in the mounting and demounting position.

4. An apparatus according to claim 1, wherein said image forming unit includes an urging member for urging said preventing member to the preventing position, and a gap is provided between said preventing member and said portion-to-be-prevented so that said preventing member and said portion-to-be-prevented are not in contact with each other in a state that said preventing member prevents said portion-to-be-prevented, and wherein movement of said cartridge relative to said image forming unit is limited within a range of the gap.

5. An apparatus according to claim 1, wherein said image forming unit includes an elastic member for urging said preventing member to the preventing position, and wherein said elastic member has such an elastic force that when said image forming unit moves between the image formation position and the mounting and demounting position, said preventing member is maintained in the preventing position and that when a user mounts and dismounts said cartridge relative to said mounting portion, said preventing member is permitted to move to the permitting position.

6. An apparatus according to claim 1, wherein said preventing member includes a first inclined surface which is inclined in a direction of mounting said cartridge to said mounting portion, and a second inclined surface which is inclined in a direction in which said cartridge is dismounted from said mounting portion, wherein when said cartridge is mounted to the mounting portion, said preventing member is moved from the preventing position to the permitting position by contact of said portion-to-be-prevented to said first inclined surface, and wherein when said cartridge is dismounted from the mounting portion, said preventing member is moved from the preventing position to the permitting position by contact of said portion-to-be-prevented to said second inclined surface.

7. An apparatus according to claim 1, wherein said cartridge includes a developing roller for forming the developed image by developing an electrostatic latent image formed on the electrophotographic photosensitive drum with a developer, and wherein said portion-to-be-prevented includes a projection provided outside one longitudinal end portion of said developing roller.

8. An apparatus according to claim 7, wherein said portion-to-be-prevented is provided outside each of one and the other longitudinal end portions of said developing roller, and said preventing member and said urging member are provided at each of one and the other end portions of said image forming unit with respect to a direction perpendicular to a mounting direction in which said cartridge is mounted to said mounting portion, and wherein said cartridge is limited so as not to move outwardly of said image forming unit at the one and the other longitudinal end portions.

9. An apparatus according to claim 1, wherein said cartridge includes a developing roller for forming the developed image by developing an electrostatic latent image formed on said electrophotographic photosensitive drum with a developer, and said main assembly includes a cartridge urging member for urging said developing roller to said electrophotographic photosensitive drum by contacting said cartridge when said image forming unit is in the image forming position.

10. An apparatus according to claim 1, wherein said image forming unit is rotatable between the image forming position and the mounting and demounting position.

11. An apparatus according to claim 1, wherein said electrophotographic image forming apparatus is a color electrophotographic image forming apparatus, and a plurality of such cartridges containing different color developers are mountable to said mounting portion.

12. An apparatus according to claim 1, wherein said image forming unit includes an electrophotographic photosensitive drum.

* * * * *